US006184631B1

(12) United States Patent
Noma et al.

(10) Patent No.: US 6,184,631 B1
(45) Date of Patent: Feb. 6, 2001

(54) PIEZOELECTRIC INVERTER

(75) Inventors: Takashi Noma, Moriyama; Yasuyuki Morishima, Kyotanabe, both of (JP)

(73) Assignee: Murata Manufacturing Co., Ltd. (JP)

( * ) Notice: Under 35 U.S.C. 154(b), the term of this patent shall be extended for 0 days.

(21) Appl. No.: 09/526,961

(22) Filed: Mar. 16, 2000

(30) Foreign Application Priority Data

Apr. 8, 1999 (JP) ..... 11-101699

(51) Int. Cl.[7] ..... H05B 37/02

(52) U.S. Cl. ..... 315/224; 315/209 PZ; 315/291; 310/318; 310/311

(58) Field of Search ..... 315/209 PZ, 209 R, 315/219, 225, 224, 291, 307, 308; 310/311, 314, 318, 359, 365; 323/299, 301, 355, 358

(56) References Cited

U.S. PATENT DOCUMENTS

| | | | | |
|---|---|---|---|---|
| 5,705,877 | * | 1/1998 | Shimada | 310/318 |
| 5,705,879 | * | 1/1998 | Abe et al. | 310/359 |
| 5,886,477 | * | 3/1999 | Honbo et al. | 315/209 PZ |
| 5,886,514 | * | 3/1999 | Iguchi et al. | 323/299 |
| 5,894,184 | * | 4/1999 | Furuhashi et al. | 310/316.01 |

FOREIGN PATENT DOCUMENTS

| | | |
|---|---|---|
| 4-168973 | 6/1992 | (JP) . |
| 7-220888 | 8/1995 | (JP) . |
| 8-107678 | 4/1996 | (JP) . |
| 10-94263 | 4/1998 | (JP) . |
| 10-127058 | 5/1998 | (JP) . |
| 10-174459 | 6/1998 | (JP) . |
| 10-247593 | 9/1998 | (JP) . |
| 11-67474 | 3/1999 | (JP) . |

* cited by examiner

*Primary Examiner*—Haissa Philogene
(74) *Attorney, Agent, or Firm*—Ostrolenk, Faber, Gerb & Soffen, LLP

(57) ABSTRACT

A piezoelectric inverter is disclosed. In the piezoelectric inverter, an input voltage controller, having a switching transistor and a current circulatingelement, converts an input voltage into a rectangular pulse alternating-current voltage. A piezoelectric transformer driver, having an inductive element, outputs an alternating-current voltage having a substantially constant frequency lower than the frequency of the alternating-current voltage output from the input voltage controller. A load current detect or detects a load current flowing through a discharge tube connected to a piezoelectric transformer. A duty factor controller controls the duty factor of the rectangular pulse of the input voltage controller in response to the output of the load current detector so that the load current coincides with a substantially constant target current value. The piezoelectric inverter thus controls the mean voltage of the alternating-current voltage applied to the piezoelectric transformer.

16 Claims, 15 Drawing Sheets

PIEZOELECTRIC INVERTER

BACKGROUND OF THE INVENTION

1. Field of the Invention

The present invention relates to a piezoelectric inverter for driving a load using a piezoelectric transformer, and, more particularly, to a piezoelectric inverter that is preferably used as a lighting circuit for a discharge tube, such as a cold-cathode tube for use in a liquid-crystal backlight.

2. Description of the Related Art

Small cold-cathode tubes are conventionally used as an backlight illumination source for a liquid-crystal display apparatus. To drive a cold-cathode tube, a piezoelectric transformer, rather than a magnetic transformer, is used because of the compact design and low cost thereof.

Japanese Unexamined Patent Publication No. 7-220888 discloses a driver of a backlight cold-cathode tube employing a piezoelectric transformer. According to this disclosure, a chopper circuit is connected between a direct-current power source and an inverter driving the piezoelectric transformer. The piezoelectric transformer is connected to the cold-cathode tube, and a current flowing through the cold-cathode tube is detected by a tube current detector circuit. The luminance of the cold-cathode tube is maintained constant by controlling a duty factor of the chopper circuit to maintain the tube current constant.

Japanese Unexamined Patent Publication No. 9-107684 discloses a piezoelectric transformer drive circuit which controls a tube current to a desired value by making use of frequency-versus-gain characteristics of the piezoelectric transformer. Connected between an input terminal and the piezoelectric transformer are a drive voltage control circuit having no parts for rectifying and smoothing, and a voltage multiplication circuit. The drive voltage control circuit maintains constant a mean input voltage applied to the voltage multiplication circuit. A cold-cathode tube is connected to the piezoelectric transformer. Also provided is a frequency control circuit which detects a current flowing through the cold-cathode tube, and controls the tube current to a desired value taking advantage of the frequency-versus-gain characteristics of the piezoelectric transformer.

When the input voltage to the voltage multiplication circuit increases with no drive voltage control circuit employed in the control method using the frequency-versus-gain characteristics of the piezoelectric transformer, a drive voltage frequency of the piezoelectric transformer shifts to a high frequency side where the voltage multiplication ratio or gain of the piezoelectric transformer is small, thereby cancelling the increase in the input voltage. The conversion efficiency of the piezoelectric transformer drops in a frequency region where the voltage multiplication ratio is small. In this conventional art, the drive voltage control circuit maintains constant the mean voltage to the voltage multiplication circuit, thereby maintaining the drive voltage frequency of the piezoelectric transformer to a frequency at which efficiency is high. It is therefore believed that the conventional art keeps a relatively high efficiency within a wide input voltage range.

In the conventional art disclosed in Japanese Unexamined Patent Publication No. 7-220888, the output of the chopper circuit is a direct current, and the chopper circuit is thought to be a DC-DC converter. To construct the chopper circuit of a DC-DC converter, inductors and capacitors, for rectifying and smoothing, are required. The component count of the circuit increases, and loss attributed thereto is also increased.

The piezoelectric transformer drive circuit, disclosed in Japanese Unexamined Patent Publication No. 9-107684, needs no rectifier circuit, thereby avoiding the loss attributed thereto.

The conventional art, disclosed in Japanese unexamined Patent Publication No. 9-107684, however, needs two types of feedback control: 1) frequency control for maintaining constant the tube current through a frequency control circuit, and 2) pulse width duty factor control through the drive voltage control circuit for maintaining constant the voltage input to the voltage multiplication circuit. The control circuit therefore becomes complicated, increasing costs involved.

SUMMARY OF THE INVENTION

Accordingly, it is an object of the present invention to provide a piezoelectric inverter which is low cost, has a simplified control circuit, free from the above problem, needs no rectifying and smoothing circuits, and reliably drives a load using a piezoelectric transformer.

According to one broad aspect of the present invention, a piezoelectric inverter for driving a load using a piezoelectric transformer, includes an input voltage controller, having a switching transistor and a current circulating element, for converting a direct-current input voltage into a rectangular alternating-current voltage, a piezoelectric transformer driver, connected between the input voltage controller and the piezoelectric transformer, and including an inductive element, for outputting, to the piezoelectric transformer, an alternating-current voltage having a substantially constant frequency that is lower than the frequency of an output alternating-current voltage of the input voltage controller, a first oscillator for determining an operating frequency of the input voltage controller, a second oscillator for determining an operating frequency of the piezoelectric transformer driver, the piezoelectric transformer having an input electrode and an output electrode with the input electrode thereof connected to the piezoelectric transformer driver and the output electrode thereof connected to the load, a load current detector, connected to the load, for detecting a load current, and a duty factor controller, connected to the load current detector, for controlling a duty factor of a rectangular pulse of the input voltage controller in response to the output of the load current detector so that the load current is maintained to a substantially constant target current value, wherein an oscillation frequency of the second oscillator is not higher than a frequency at which the voltage multiplication ratio of the piezoelectric transformer becomes maximized with no load applied to the output of the piezoelectric transformer, and the oscillation frequency of the second oscillator is not lower than a frequency at which the voltage multiplication ratio of the piezoelectric transformer becomes maximized with the piezoelectric transformer driving the load connected to the output thereof.

Preferably, the second oscillator includes a frequency divider that frequency-divides the frequency of the first oscillator, and a signal into which the frequency of the first oscillator is divided is the output of the second oscillator, and a single oscillator is shared by the first oscillator and the second oscillator.

Preferably, a piezoelectric inverter of the present invention further includes a temperature-compensating circuit which controls the temperature dependence of required mean output voltage of the input voltage controller, thereby compensating for the dependence of the oscillation frequency of the second oscillator on ambient temperature.

The temperature-compensating circuit preferably includes one of a thermistor or a temperature-compensating capacitor.

The target current value is preferably changed in response to an externally applied, first dimmer signal.

Preferably, a piezoelectric inverter of the present invention further includes a variable oscillation-frequency circuit that varies the oscillation frequency of one of the first and second oscillators in response to the first dimmer signal without using feedback control. The oscillation frequency of the second oscillator may be varied by varying the output frequency of the first oscillator, and then by frequency-dividing the output frequency of the first oscillator. Preferably, a piezoelectric inverter of the present invention further includes a load drive time controller which varies an on time ratio of the load in response to an externally applied, second dimmer signal by intermittently switching on and off the driving of the load.

Preferably, a piezoelectric inverter of the present invention further includes a rectifier for rectifying the load current detected by the load current detector and outputting a direct current in response to the load current, wherein, when the inverter works to set the load to be in an on state, or the load is in an on state, a voltage, substantially equal to a voltage occurring at the output of the rectifier, is applied to the output of the rectifier during a period throughout which the inverter operates to set the load to be in an off state, or the load is in an off state.

Preferably, a piezoelectric inverter further includes a dead-time controller for controlling a duty factor of a rectangular pulse of the input voltage controller to be not higher than a constant value, without dependence on a current flowing through the load and the output voltage of the rectifier, wherein the duty factor of the rectangular pulse controlled by the dead-time controller varies in response to an input voltage.

Preferably, a piezoelectric inverter further includes a circuit operation stopping unit which stops the operation of the inverter when a duration, during which the current flowing through the load fails to coincide with the target current value, exceeds a predetermined constant duration of time.

Preferably, a constant duration from the occurrence of an abnormal event to a stop of the operation of the circuit is varied by a constant of an externally connected component.

Preferably, an excessive rise in the output voltage of the piezoelectric transformer is prevented by varying, toward a high frequency side, the oscillation frequency of the second oscillator when the output voltage of the piezoelectric transformer exceeds a desired value. In this case, the frequency of the first oscillator may be varied, and is then frequency-divided as a frequency of the second oscillator. Alternatively, an excessive rise in the output voltage of the piezoelectric transformer may be prevented by decreasing the duty factor of the output rectangular pulse of the input voltage controller when the output voltage of the piezoelectric transformer exceeds a desired value. Preferably, a start-up operation is carried out while the oscillation frequency of the second oscillator sweeps from a high frequency side to a low frequency side.

Preferably, the oscillation frequency of the second oscillator is shifted to a low frequency lower than a normal oscillation frequency thereof when the input voltage is lower than a desired frequency.

The piezoelectric inverter of this invention is used to drive a variety of loads, and is suited for use in lighting and light adjustment control of a discharge tube in particular. Such discharge tubes include, but not limited to, a cold-cathode tube for a liquid-crystal backlight.

DESCRIPTION OF THE PREFERRED EMBODIMENTS

Figure 1:
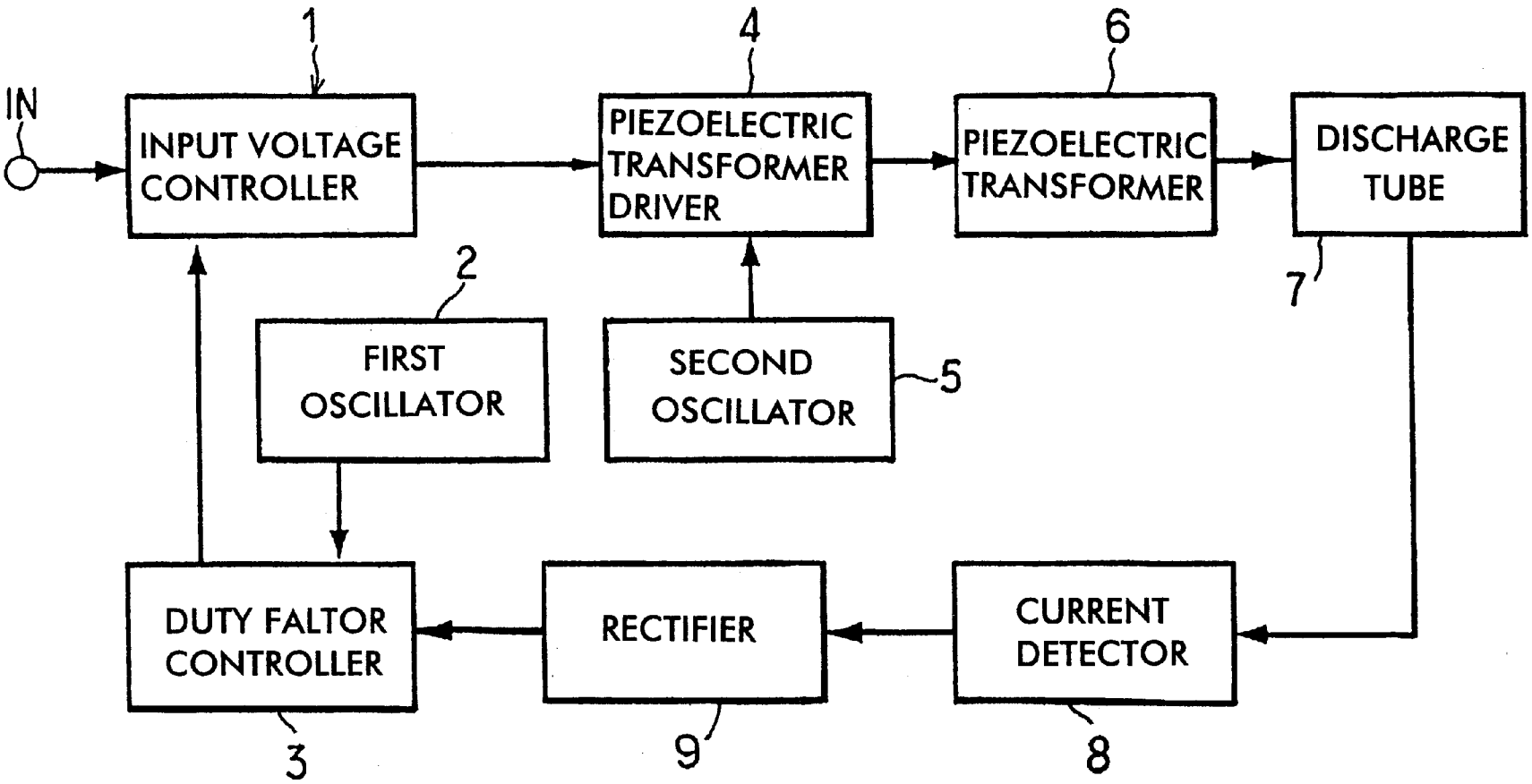
FIG. 1 is a block diagram generally showing a piezoelectric inverter of a first embodiment of the present invention.

The present invention is now discussed in more detail, referring to the drawings.

Figure 2:
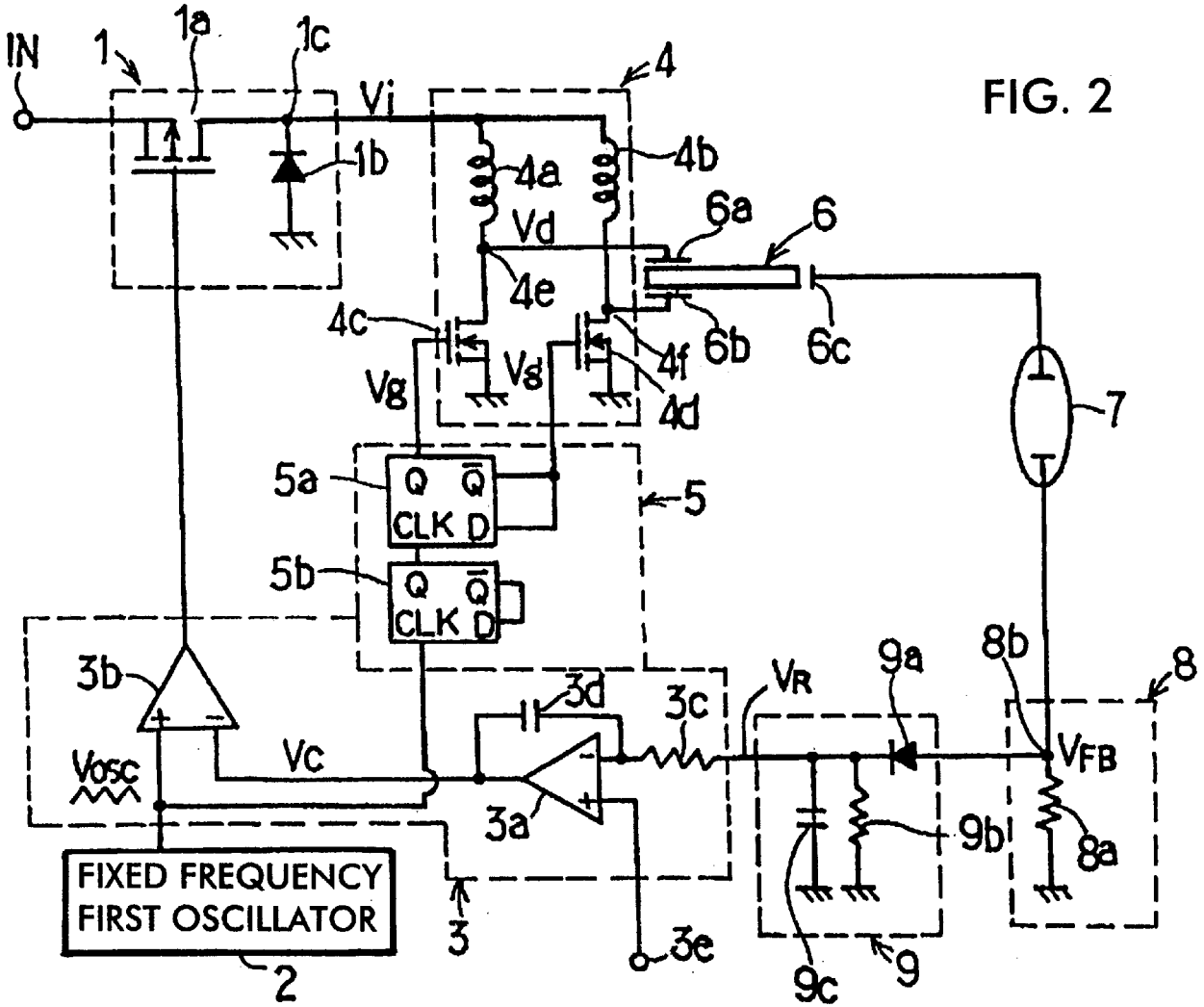
FIG. 2 is a circuit diagram specifically showing the circuit of the piezoelectric inverter shown in FIG. 1.

FIG. 1 is a block diagram generally showing a piezoelectric inverter of a first embodiment of the present invention, and FIG. 2 is a circuit diagram specifically showing the circuit of the piezoelectric inverter shown in FIG. 1.

Referring to FIG. 1, an input voltage controller 1 (input voltage control means) receives an input voltage in the piezoelectric inverter of the present invention. The input voltage controller 1 turns on and off the input voltage at a predetermined frequency, thereby converting the input voltage into a rectangular alternating-current voltage. The input voltage controller 1 is composed of a voltage stepdown chopper circuit including neither rectifying circuit nor smoothing circuit.

A first oscillator 2 is connected to the input voltage controller 1 through a duty factor controller 3. The first oscillator 2 is used to provide the predetermined frequency to the input voltage controller 1.

The input voltage controller 1 is connected to a piezoelectric transformer driver 4. The piezoelectric transformer driver 4 is connected to a second oscillator 5. The piezoelectric transformer driver 4 performs a switching operation at a frequency determined by the second oscillator 5.

Specifically, the piezoelectric transformer driver 4 converts the rectangular alternating-current voltage input from the input voltage controller 1 into an alternating-current voltage having the frequency derived from the second oscillator 5 as a main component thereof. The piezoelectric transformer driver 4 includes an inductive element, i.e., an inductor or an electromagnetic transformer.

The oscillation frequency of the second oscillator 5 is set to be lower than the oscillation frequency of the first oscillator 2. Preferably, the oscillation frequency of the second oscillator 5 is set to be equal to or lower than one-quarter of the oscillation frequency of the first oscillator 2.

A piezoelectric transformer 6 is fabricated of a known Rosen-type piezoelectric transformer. The piezoelectric transformer driver 4 applies the alternating-current voltage to an input terminal of the piezoelectric transformer 6. The piezoelectric transformer 6 multiplies the input alternating-current voltage and then outputs an alternating-current voltage. The alternating-current voltage output from the piezoelectric transformer 6 is applied to a discharge tube 7 as a load.

The discharge tube 7 is connected to a current detector 8, which detects a current flowing through the discharge tube 7, namely, a load current.

A rectifier 9 is connected to an output terminal of the current detector 8. The rectifier 9 rectifies the load current detected through the current detector 8 at a certain time constant, and outputs a direct-current voltage responsive to the load current.

The rectifier 9 is then connected to the duty factor controller 3. The duty factor controller 3 compares the output voltage of the rectifier 9 to a target voltage corresponding to a predetermined target load current, and controls the duty factor of the rectangular pulse of the input voltage controller 1 so that the output voltage of the rectifier 9 coincides with the target voltage.

In the circuit arrangement shown in FIG. 1, the voltage control means in this invention includes, in a broad sense, the input voltage controller 1, the first oscillator 2, the duty factor controller 3, the piezoelectric transformer driver 4, the second oscillator 5, the current detector 8, and the rectifier 9. The voltage control means thus controls the mean voltage of the alternating-current voltage input to the piezoelectric transformer 6 so that the current flowing through the load coincides with the target current value.

The operation of the piezoelectric inverter shown in FIG. 1 is now discussed.

At startup, a direct-current input voltage from a power source is applied to the input voltage controller 1, and is converted into a rectangular alternating-current voltage in accordance with the oscillation frequency provided by the first oscillator 2. The rectangular alternating-current voltage is then fed to the piezoelectric transformer driver 4, which in turn performs a switching operation in accordance with the oscillation frequency of the second oscillator 5 to switch on and off the input alternating-current voltage.

The oscillation frequency of the first oscillator 2 is higher than the oscillation frequency of the second oscillator 5, and the inductive element arranged in the piezoelectric transformer driver 4 removes the frequency component derived from the first oscillator 2. The piezoelectric transformer driver 4 outputs almost no frequency component derived from the first oscillator 2 in the output voltage thereof, and the main component of the output voltage thereof is a frequency component of the second oscillator 5.

The piezoelectric transformer driver 4 drives the piezoelectric transformer 6, and the piezoelectric transformer 6 outputs a high-tension voltage at the output terminal thereof, namely, the output electrode thereof, causing the discharge tube 7 to light. When the discharge tube 7 is lit, a current, namely, a load current starts flowing therethrough.

The load current is detected by the current detector 8, and a direct-current voltage responsive to the magnitude of the load current is output by the rectifier 9. The duty factor controller 3 compares the direct-current voltage of the rectifier 9 to the constant target voltage corresponding to the target load current and controls the duty factor of the rectangular pulse of the input voltage controller 1 so that the two voltages coincide with each other. The load current is thus controlled to the target current value, and luminance of the discharge tube 7 is thus maintained constant.

An increase in the load current due to an external disturbance is now considered. The increase in the load current causes the voltages of the current detector 8 and the rectifier 9 to rise. As a result, a difference occurs between the target voltage value and the direct-current voltage. In response to the difference, the duty factor controller 3 reduces the duty factor of the rectangular pulse. The method of reducing the duty factor is not limited to any particular method. For instance, an on time ratio of a switching element in the input voltage controller 1 is reduced, thereby lowering the mean voltage of the input voltage controller 1.

The piezoelectric transformer 6 operates at a substantially constant frequency determined by the oscillation frequency of the second oscillator 5. When the voltage input to the piezoelectric transformer driver 4 drops, the output voltage of the piezoelectric transformer driver 4 also drops accordingly.

The load current decreases, controlling the effect of the initial external disturbance.

When the load current drops due to an external disturbance, control in the opposite direction is performed, thereby maintaining constant the load current.

In the piezoelectric inverter shown in FIG. 1, the input voltage controller 1 converts the input voltage into the rectangular alternating-current voltage based on the oscillation frequency of the first oscillator 2, and the duty factor controller 3 compares the direct-current voltage output by the rectifier 9 to the target voltage corresponding to the target current value, and controls the rectangular pulse duty factor of the input voltage controller 1 so that the two voltages coincide with each other. The piezoelectric inverter thus controls the load current to the target load current value. Since a voltage stepdown chopper circuit having neither rectifying circuit nor smoothing circuit is employed as the input voltage controller 1, the component count is reduced, and loss involved is reduced accordingly. Since feedback control is used in the duty factor controller 3 only, the circuit arrangement of the control system is simplified.

Referring to FIG. 2, the piezoelectric inverter of this embodiment is specifically discussed.

In the circuit diagram shown in FIG. 2, the input voltage controller 1 is composed of a P-type FET1*a* as a switching element and a diode 1*b* as a current circulating element. Specifically, the source of the FET1*a* is connected to an input terminal IN, and the drain thereof is connected to the piezoelectric transformer driver 4. The gate of the FET1*a* is connected to the duty factor controller 3. The diode 1*b* is connected between a junction 1*c* of the drain of the FET1*a* and the piezoelectric transformer driver 4 and ground in a manner such that the forward direction thereof is aligned to the junction 1*c*.

The diode 1*b* is arranged so that no surge voltage occurs in response to a sharp change in the inductor current of the piezoelectric transformer driver 4 when the FET1*a* is turned off.

The piezoelectric transformer driver 4 includes two inductors 4*a* and 4*b*, and two N-type FET4*c* and N-type FET4*d*. Specifically, ends of two inductors 4*a* and 4*b* are connected to the input terminal of the piezoelectric transformer driver 4 in parallel. The other ends of the inductors 4*a* and 4*b* are respectively connected to drains of the FET4*c* and FET4*d*. The sources of the FET4*c* and FET4*d* are respectively grounded. The gates of the FET4*c* and FET4*d* are respectively connected to the second oscillator 5.

A junction 4*e* of the inductor 4*a* and the drain of the FET4*c* forms one output terminal of the piezoelectric transformer driver 4, and a junction 4*f* of the inductor 4*b* and the drain of the FET4*d* forms a second output terminal of the piezoelectric transformer driver 4. In other words, the FET4*c* and FET4*d* form a push-pull circuit.

The piezoelectric transformer 6 includes a pair of input electrodes 6*a* and 6*b* and an output electrode 6*c*. The input electrode 6*a* is connected to the junction 4*e*, and the input electrode 6*b* is connected to the junction 4*f*. The piezoelectric transformer 6 is thus driven by the alternating-current voltage output by the piezoelectric transformer driver 4.

The voltage stepped up by the piezoelectric transformer 6 is output to the output electrode 6*c*. The output electrode 6*c* is connected to one terminal of the discharge tube 7.

A current detector resistor 8*a* forming the current detector 8 is connected between the other terminal of the discharge tube 7 and ground potential.

The rectifier 9 is connected to a junction 8*b* of the other terminal of the discharge tube 7 and the resistor 8*a*. The rectifier 9 includes a diode 9*a*, a resistor 9*b*, and a capacitor 9*c*. The diode 9*a* is connected to the junction 8*b* in such a manner that the backward direction thereof is aligned to the junction 8*b*. The resistor 9*b* and the capacitor 9*c* are connected in parallel between the other terminal of the diode 9*a* and ground potential.

The output terminal of the rectifier 9 is connected to the duty factor controller 3. The duty factor controller 3 includes two comparators 3*a* and 3*b*. The output of the rectifier 9 is fed to an inverting input terminal of the comparator 3*a* through a resistor 3*c*. A capacitor 3*d* is connected between the inverting input terminal of the comparator 3*a* and the output terminal of the comparator 3*a*. A first dimmer signal, corresponding to a target load current value, is fed to a normal input terminal of the comparator 3*a* via a first dimmer signal input terminal 3*e* from outside. The first dimmer signal is a direct-current voltage signal corresponding to the target load current value.

The comparator 3*a* compares the direct-current output voltage $V_R$ responsive to the load current provided by the rectifier 9, to the first dimmer signal, thereby outputting a voltage signal Vc.

The output of the comparator 3*a* is coupled to an inverting input terminal of the comparator 3*b*. The first oscillator 2 is connected to a normal input terminal of the comparator 3*b*. Also connected to the normal input terminal of the comparator 3*b* is an input terminal of the second oscillator 5.

The first oscillator 2 is an oscillator having a fixed frequency, and is fabricated of a piezoelectric ceramic, for instance.

The comparator 3*b* compares a triangular wave output from the first oscillator 2 to an output wave from the comparator 3*a*, and outputs a signal having a duty factor responsive to the output voltage Vc of the comparator 3*a*. This arrangement for pulse-width modulation control is widely used in the field of DC-DC converters.

In this embodiment, the output of the first oscillator 2 is divided by four, and is output as the output of the second oscillator 5. Specifically, the second oscillator 5 is composed of a frequency divider circuit having D flipflops 5*a* and 5*b*. The output of the second oscillator 5 is a two-phase output. With its duty factor precisely set to 50%, the two-phase output is advantageously used to perform push-pull driving in the piezoelectric transformer driver 4.

Referring to the circuit diagram shown in FIG. 2, the operation of the piezoelectric inverter is discussed.

An input voltage is fed to the input voltage controller 1 via the input terminal IN. The operation of the input voltage controller 1 remains unchanged from the one described with reference to FIG. 1. Specifically, the input voltage controller 1 converts the input voltage into the rectangular alternating-current voltage. The waveform of the output voltage Vi of the input voltage controller 1 is shown in FIG. 3.

Figure 3:
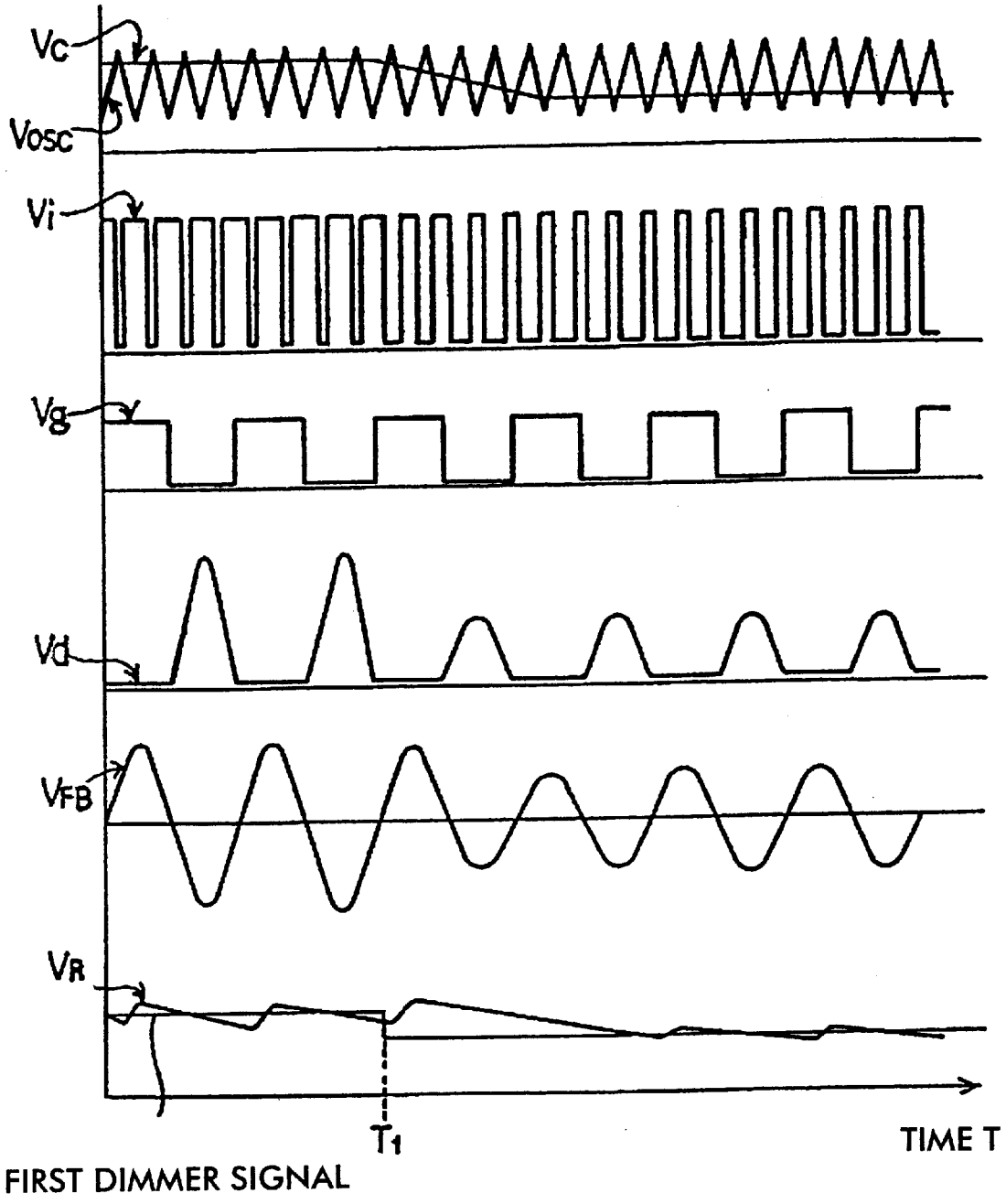
FIG. 3 is a waveform diagram of voltages at various points in the circuit of the piezoelectric inverter shown in FIG. 2.

FIG. 3 shows the waveforms of various voltage signals. Each waveform is drawn on its own level, for instance, the output voltage Vi drawn above a gate voltage Vg does not mean that the output voltage Vi is higher in level than the gate voltage Vg.

When the gate voltage Vg of the FET4*c* and FET4*d* becomes high in the piezoelectric transformer driver 4, the FET4*c* and FET4*d* are turned on, thereby causing current energy from the input voltage controller 1 to build up in the inductors 4*a* and 4*b*. When the FET4*c* and FET4*d* are turned off, stored current energy is switched to the input electrodes of the piezoelectric transformer 6. The output voltage Vd of the piezoelectric transformer driver 4 is shown in FIG. 3.

With this circuit arrangement, the peak value of the output voltage Vd of the piezoelectric transformer driver 4 is stepped up to a voltage approximately three times as high as the mean voltage of the output voltage Vi of the input voltage controller 1.

In this embodiment, the operational frequency of the input voltage controller 1 is four times as high as the operational frequency of the piezoelectric transformer driver 4. The output voltage of the input voltage controller 1 is smoothed by the inductors 4*a* and 4*b* of the piezoelectric transformer driver 4, and almost no frequency component of the input voltage controller 1 appears in the piezoelectric transformer driver 4.

In t his way, the piezoelectric transformer 6 is driven and the output of the piezoelectric transformer 6 causes the discharge tube 7 to light.

The method of controlling the load current to a substantially constant value is now discussed, referring to FIG. 2.

Now the load current becomes excessively large due to some external disturbance in FIG. 2. The current detector 8 voltage-current converts the load current, thereby resulting in a voltage $V_{FB}$ responsive to the load current.

The voltage $V_{FB}$ is rectified by the rectifier 9 at a predetermined time constant. The time constant is adjusted by adjusting the values of the diode 9*a*, the resistor 9*b*, and the capacitor 9*c*.

The rectifier 9 then results in an output voltage $V_R$.

Since the load current is now large, the output voltage $V_R$ of the rectifier 9 becomes larger than the externally applied first dimmer signal. The comparator 3*a* decreases the output voltage Vc thereof at a time constant determined by the resistor 3*c* connected between the rectifier 9 and the inverting input terminal of the comparator 3*a* and the capacitor 3*d* connected between the output terminal and the inverted input terminal of the comparator 3*a*.

The output voltage Vc of the comparator 3*a* is compared to the output $V_{OSC}$ of the first oscillator 2, i.e., the triangular wave, at the second comparator 3*b*. Since the output of the comparator 3*a* is coupled to the inverting input terminal of the comparator 3*b*, the higher the output voltage of the comparator 3*a*, the higher the ratio of a high state in the output of the comparator 3*b*.

Since the switching element in the input voltage controller 1 is a P-type FET1*a*, the switching element is turned on when the gate voltage thereof is in a low state. The higher the output of the comparator 3*b*, the higher the ratio of the off state in the EFT1*a*.

The mean value of the output voltage Vi of the input voltage controller 1 drops, and the piezoelectric transformer driver 4 and the piezoelectric transformer 6 respectively decrease the outputs thereof, reducing the load current and thereby controlling the effect of the disturbance.

Referring to FIG. 3, load current control in response to a change in the voltage of the first dimmer signal is discussed below.

At time T=0, the first dimmer signal voltage remains high as shown in FIG. 3. When the dimmer signal voltage drops at time T=T1, the output voltage Vc of the comparator 3*a*, the mean value of the output voltage Vi of the input voltage controller 1, and the peak value of the output voltage Vd of the piezoelectric transformer driver 4 respectively drop, reducing the load current. When the mean value of the output voltage $V_R$ of the rectifier 9 drops down to a level equal to the voltage of the first dimmer signal, control reaches stabilization.

In this embodiment, the load current is controlled to the constant target current value. The target value of the load current is changed by changing the first dimmer signal voltage in this way.

Since the feedback control is performed by the duty factor controller 3 only in this embodiment, the circuit arrangement required for control is simplified. Since the output of the input voltage controller 1 is an alternating-current voltage rather than a direct-current voltage, unnecessary loss, which would be caused by parts required for rectifying and smoothing, is not involved.

The direct-current voltage signal shown in FIG. 3 is used as the first dimmer signal in this embodiment. Alternatively, a multi-bit digital signal may be used. In such a case, the digital data may be digital-to-analog converted in the inverter.

Figure 4:
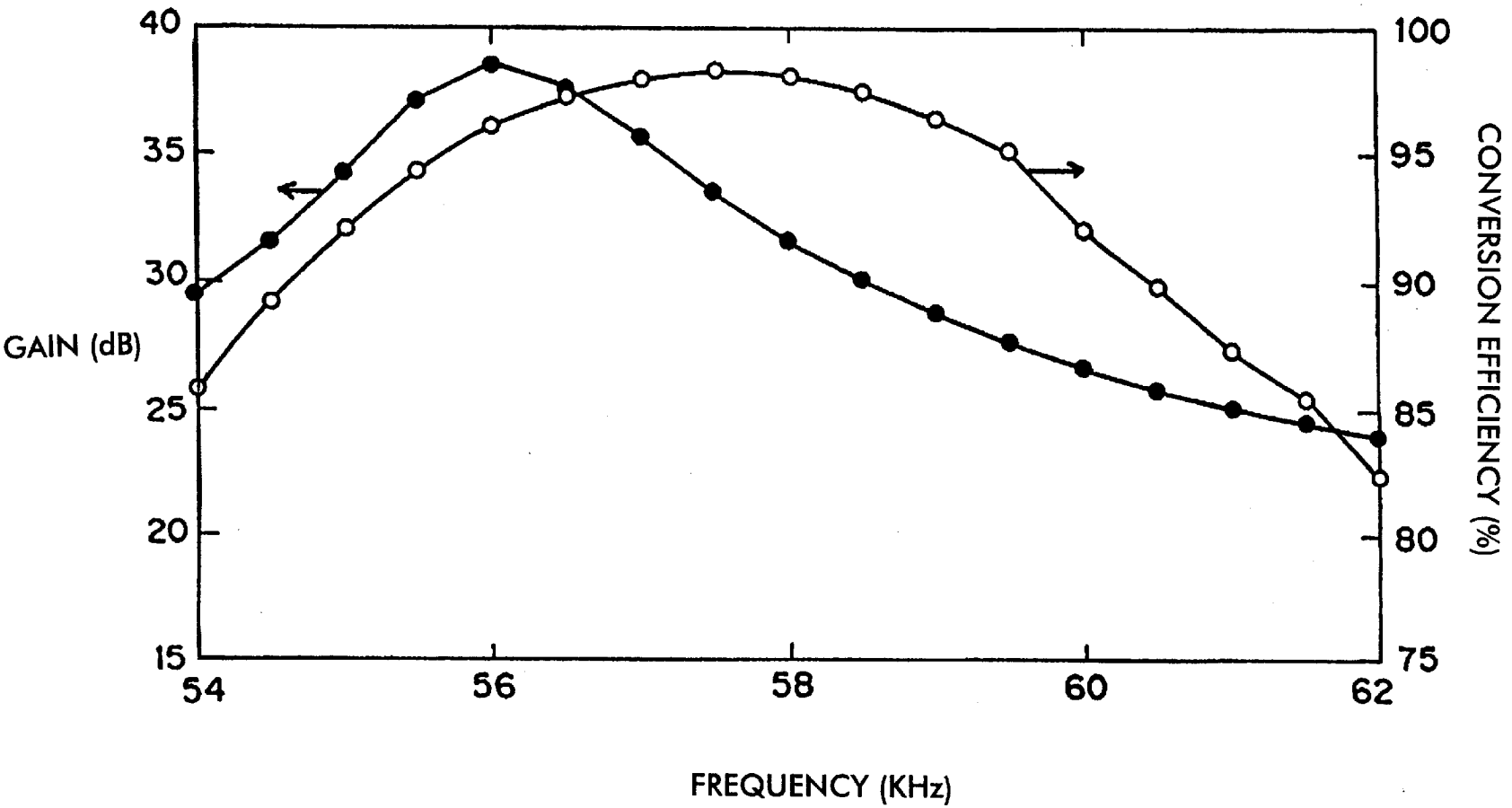
FIG. 4 is a graph showing frequency-versus-gain characteristics of a piezoelectric transformer.
Figure 12:
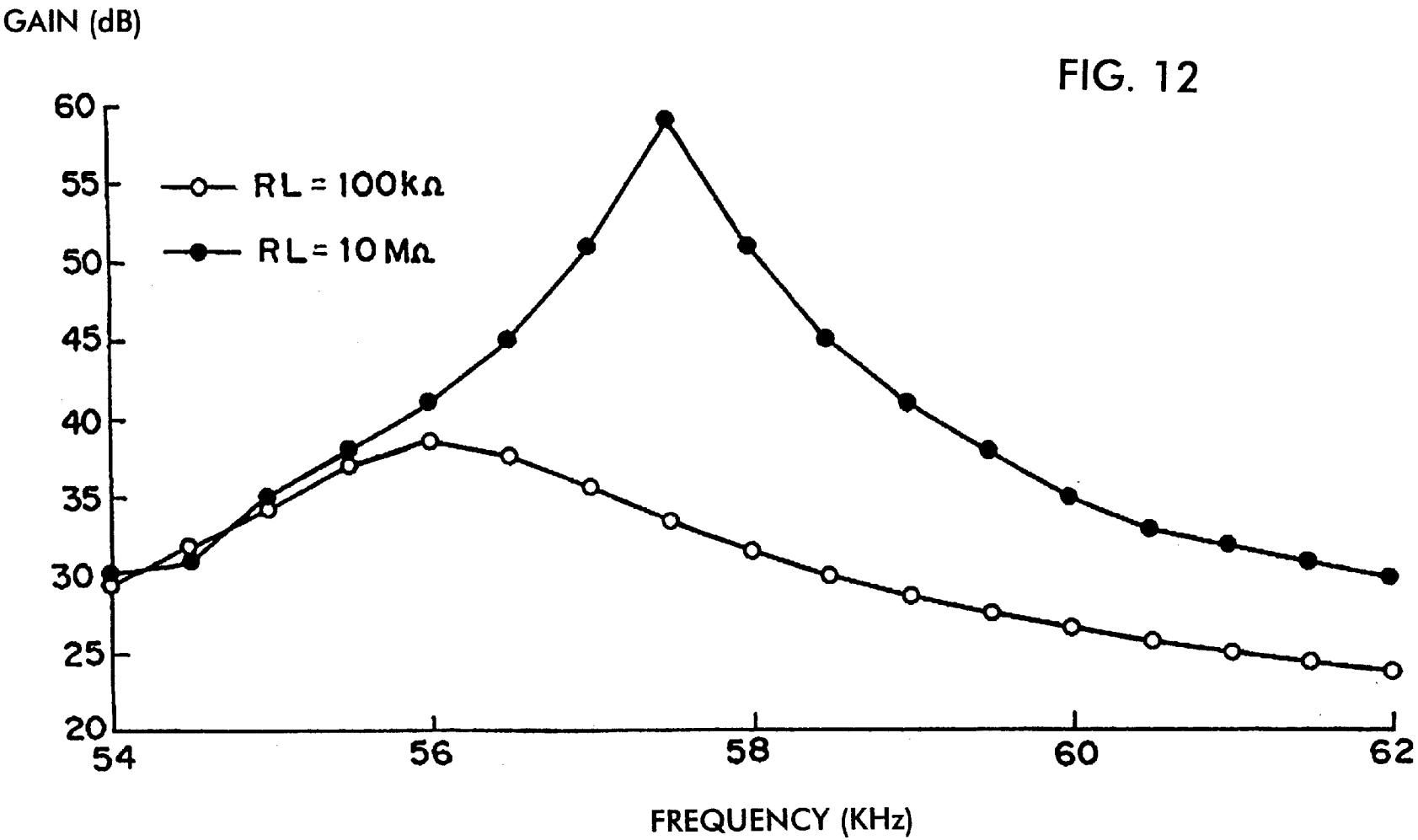
FIG. 12 is a graph showing frequency-versus-gain characteristics of a piezoelectric transformer with a high-impedance load and a low-impedance load connected thereto.

FIG. 4 shows frequency-versus-gain characteristics and frequency-versus-conversion efficiency characteristics of the piezoelectric transformer 6 with a load resistor of 100 kΩ. FIG. 12 shows voltage multiplication characteristics of the piezoelectric transformer 6 with the load resistor switched from 100 kΩ to 10 MΩ.

It is known that insufficient impedance matching between the output impedance of the piezoelectric transformer 6 and the impedance of the discharge tube 7 causes the load current to pulsate or causes the discharge tube 7 to intermittently light. Such a load current pulsation is not controlled by the circuit. The type and operating conditions of the piezoelectric transformer 6 need to be properly selected.

According to a study carried out by the inventors of this invention, if a frequency is selected from within a range not higher than a frequency giving a maximum voltage multiplication ratio with the discharge tube 7 extinguished, i.e., the load of the piezoelectric transformer 6 opened, namely, 57.5 kHz in FIG. 12, and not lower than a frequency giving a maximum voltage multiplication ratio with the discharge tube 7 lighting normally, namely, 56 kHz in FIG. 12, the load current pulsation is controlled to a minimum.

Referring to FIG. 4, the conversion efficiency of the piezoelectric transformer 6 is also maximized within the above frequency range. Driving the piezoelectric transformer 6 within the above frequency range is preferable from the standpoint of taking advantage of the characteristics of the piezoelectric inverter.

Since a drive frequency is varied to control the load current to a constant in the conventional art disclosed in Japanese Unexamined Patent Publication No. 9-107684, maintaining the drive frequency within the above frequency range is thus not achieved. In the conventional art disclosed in Japanese Unexamined Patent Publication No. 7-220888, the piezoelectric transformer is self-oscillating, and thus operates at a frequency providing a maximum voltage multiplication ratio regardless of load state.

As seen from FIG. 4, frequencies that provide a maximum efficiency of the piezoelectric transformer fall within a range slightly higher than frequencies that provide a maximum multiplication ratio. This means that the conventional art disclosed in Japanese Unexamined Patent Publication No. 7-220888 is unable to maximize the efficiency of the piezoelectric transformer 6.

In contrast, the operational frequency of the piezoelectric transformer driver 4 in the piezoelectric transformer of this embodiment is substantially constant. The piezoelectric transformer 6 is set to be driven within the above frequency range, namely, within an optimum frequency region during manufacturing process. A stable and high-efficiency piezoelectric inverter thus results.

Figure 5:
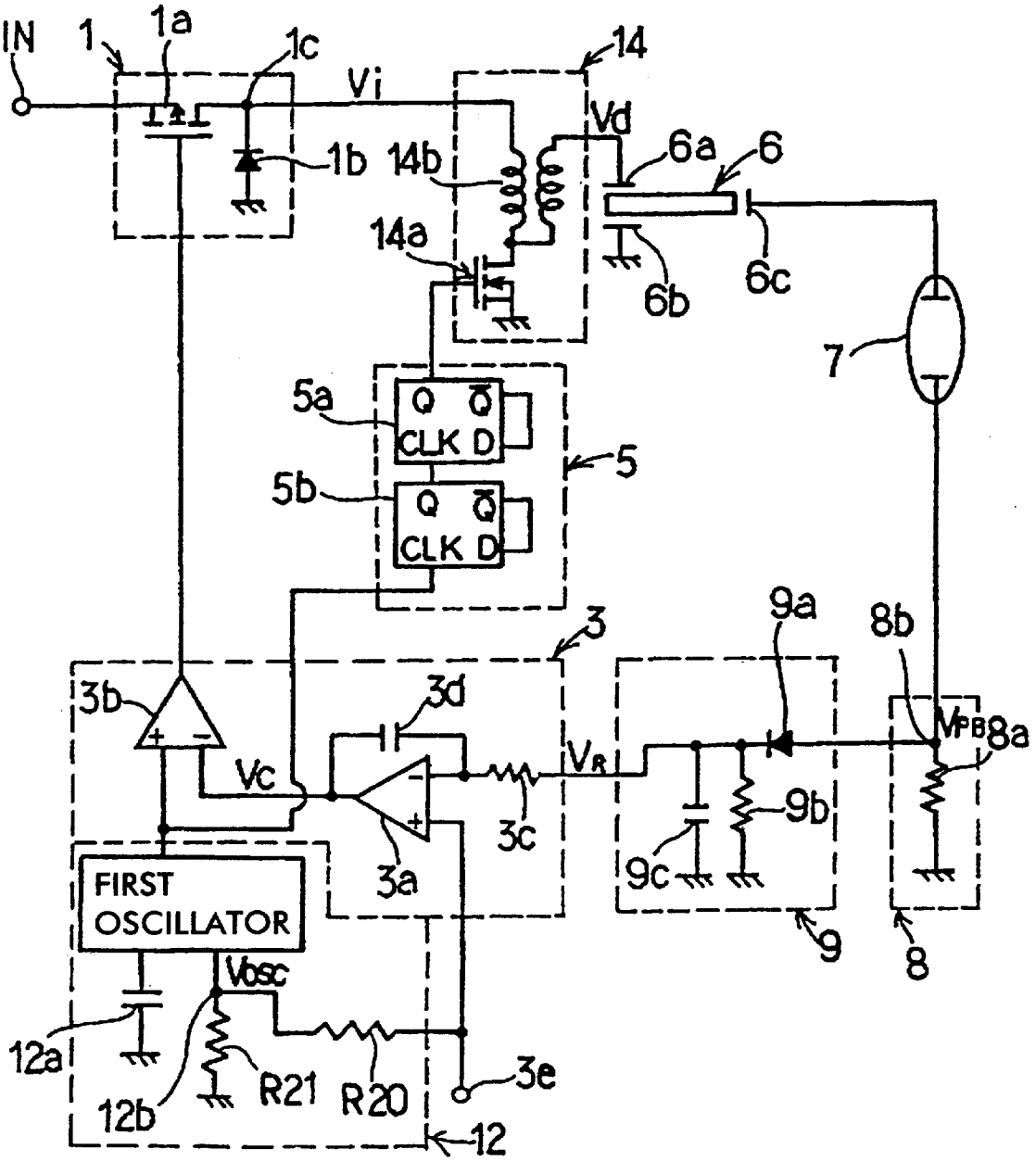
FIG. 5 is a circuit diagram of a piezoelectric inverter of a second embodiment of the present invention.

FIG. 5 is a circuit diagram showing the circuit arrangement of a piezoelectric inverter of a second embodiment of the present invention.

In the piezoelectric inverter of the second embodiment, a piezoelectric transformer driver 14 includes a single N-type FET14*a* and an auto transformer 14*b*. In the first embodiment, the circuit for driving the piezoelectric transformer 6 is a push-pull circuit composed of the two FETs, while this embodiment employs a single-ended configuration. The auto transformer 14*b* is arranged to compensate for a lack of voltage multiplication ratio of the piezoelectric transformer 6. With the auto transformer 14*b* thereof, the piezoelectric transformer driver 14 thus preliminarily steps up the alternating-current voltage input to the piezoelectric drive means 14.

One end of a primary winding of the autotransformer 14*b* is connected to the input voltage controller 1, and the other end of the primary winding thereof is connected to the drain of the FET14*a*. One end of a secondary winding of the autotransformer 14*b* is connected to the input electrode 6*a* of the piezoelectric transformer 6. The other end thereof is connected to the drain of the FET14*a*. The source of the FET14*a* is grounded, and the gate thereof is connected to the second oscillator 5.

The piezoelectric transformer driver 14 thus constructed employs such autotransformer 14*b*. Since the size of the autotransformer 14*b* is naturally bulky, the first embodiment outperforms the second embodiment in terms of compact and thin design. However, with the reduced component count thereof, the second embodiment achieves a cost reduction.

The circuit arrangement of the piezoelectric transformer driver is not limited to the ones in the first and second embodiments, and may be modified and changed as appropriate.

The second embodiment employs a temperature-compensating capacitor 12*a* for compensating for temperature characteristics of a first oscillator 12. The temperature-compensating capacitor 12*a* is connected between the first oscillator 12 and ground potential. Variations in the oscillation frequency of the first oscillator 12 due to ambient temperatures are thus compensated for.

A second oscillator 5 has a construction identical to the counterpart of the first embodiment. Specifically, the output of the second oscillator 5 is obtained by dividing the output signal of the first oscillator 12 by four, and the oscillation frequency of the second oscillator 5 is also temperature-compensated for by the above temperature-compensating circuit.

Even if the operational frequency is slightly varied, the performance of the input voltage controller 1 is not sensitive to variations. With the above circuit arrangement, the number of oscillators is reduced as in the first embodiment.

In the first embodiment, when the first dimmer signal voltage is lowered, i.e., when the target current value of the load current is set to be small, the on duty width of the pulse of the input voltage controller 1 is narrowed, and the mean output voltage of the input voltage controller 1 is controlled to be small. In a region where the on duty width is too narrow in PWM (pulse-width modulation) control, gain of the control system becomes excessively large, and assuring system stability is difficult. When the first dimmer signal voltage becomes low, the multiplication gain of the piezoelectric transformer 6 decreases. It is important to prevent the on duty width of the pulse of the input voltage controller 1 from being excessively narrowed.

One end of a resistor R20 is connected to the input terminal 3*e* of the first dimmer signal in the second embodiment, and the other end of the resistor R20 is connected to a junction 12*b* of the first oscillator 12 and a frequency-setting resistor R21. The voltage at the junction 12*b* is referred to as $V_{OSC}$.

The rest of the construction of the second embodiment remains unchanged from that of the first embodiment. Components identical to those described in connection with the first embodiment are designated with the same reference numerals and the discussion thereabout is not repeated here.

The operation of the piezoelectric inverter of the second embodiment is now discussed. When the first dimmer signal voltage is reduced, a current flowing into the junction 12*b* of the frequency-setting resistor 21 of the first oscillator 12 through the resistor R20 decreases. Since the voltage $V_{OSC}$ at the junction 12*b* is maintained constant, a current flowing out of the first oscillator 12 increases.

In other words, the resistance of the frequency-setting resistor 21 appears small, if viewed from the first oscillator 12, and the oscillation frequency of the first oscillator 12 increases. The oscillation frequency of the first oscillator 12 is divided by four, and is provided as the output of the second oscillator 5. The oscillation frequency of the second oscillator 5 is thus increased.

As already discussed, the present invention uses frequencies within the frequency range where an increase in the oscillation frequency reduces the voltage multiplication gain of the piezoelectric transformer 6. As the oscillation frequency of the second oscillator 5 increases, the voltage multiplication gain of the piezoelectric transformer 6 decreases, and the on-duty width of the pulse of the input voltage controller 1 does not become so narrow.

Conversely, when the first dimmer signal voltage rises, the load current increases, the oscillation frequency of the second oscillator 5 decreases. The voltage multiplication gain of the piezoelectric transformer 6 thus increases. A variation in the on-duty width of the pulse of the input voltage controller 1 is thus controlled.

The gain of the piezoelectric transformer 6 is roughly adjusted in response to the magnitude of the first dimmer signal voltage. By controlling the variation in the input voltage controller 1, the stability, thus reliability of the control system is increased.

In the second embodiment, feedback control is also performed by the duty factor controller 3 only. The circuit arrangement of the control circuit is thus simplified as in the first embodiment.

Figure 6:
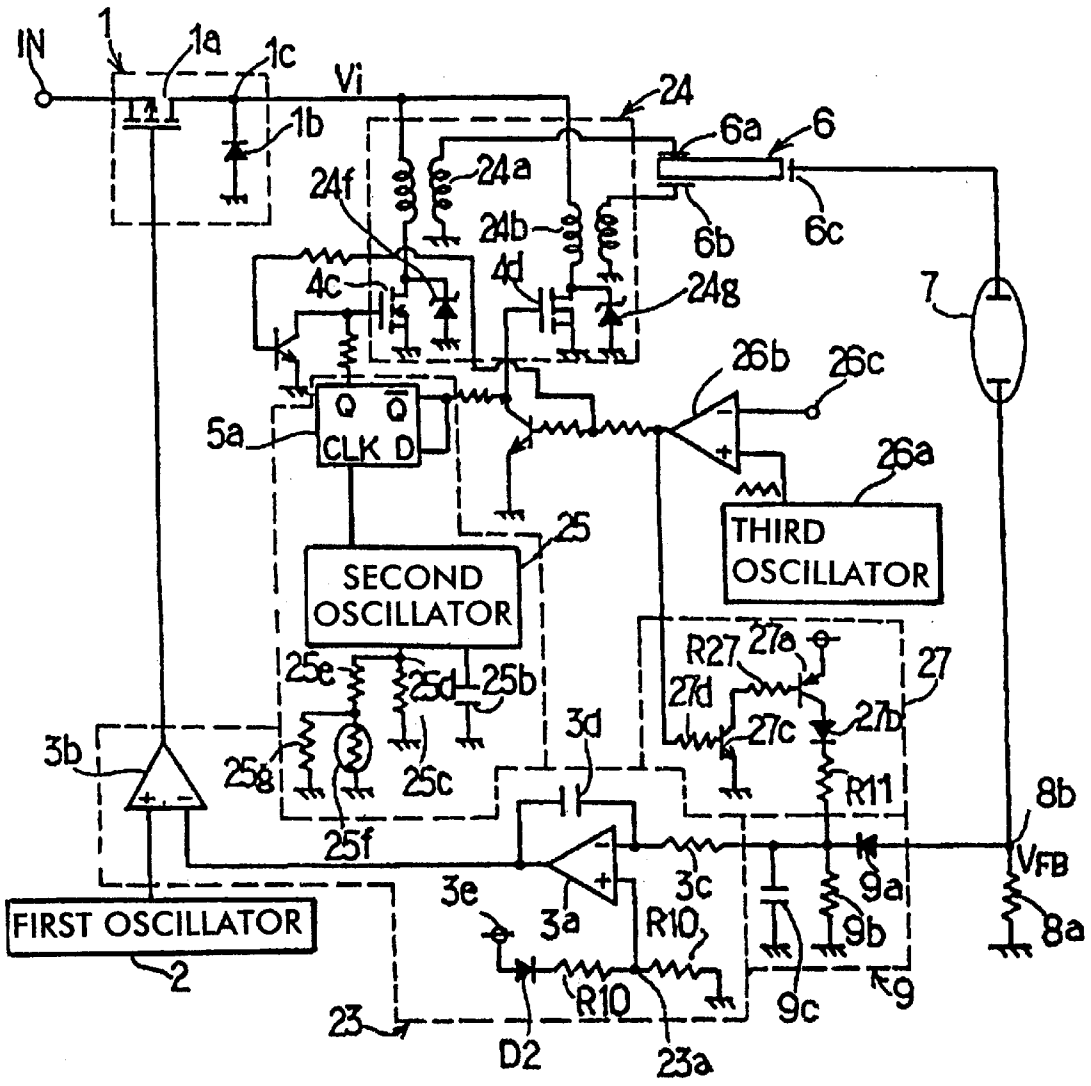
FIG. 6 is a circuit diagram of a piezoelectric inverter of a third embodiment of the present invention.

FIG. 6 is a circuit diagram of a piezoelectric inverter of a third embodiment of the present invention.

The piezoelectric inverter of the third embodiment includes a piezoelectric transformer driver 24 that is a push-pull circuit composed of two FET4*c* and FET4*d*, as in the first embodiment. In the third embodiment, however, isolating transformers 24*a* and 24*b* are substituted for the coils 4*a* and 4*b* in the first embodiment. Ends of primary windings of the isolating transformers 24*a* and 24*b* are connected to the input voltage controller 1, and the other ends thereof are respectively connected to the drains of the FET4*c* and FET4*d*. One end of a secondary winding of the isolating transformer 24*a* is connected to the input electrode 6*a* of the piezoelectric transformer 6, and the other end thereof is grounded. One end of a secondary winding of the insulating transformer 24*b* is connected to the input electrode 6*b* of the piezoelectric transformer 6, and the other end thereof is grounded.

In this embodiment, the isolating transformers 24*a* and 24*b* preliminarily step up the input voltage from the input voltage controller 1 and the piezoelectric transformer 6 fully steps up the input voltage applied thereto. A piezoelectric inverter providing a large output thus results.

In a duty factor controller 23, the input terminal 3*a* for the first dimmer signal is connected to the normal input terminal of the comparator 3*a* via a diode D2 and a resistor R10. A resistor R10' is connected between a junction 23*a* of the resistor R10 and the normal input terminal and ground potential.

The diode D2 is connected in a manner such that the forward direction thereof is aligned to the resistor R10.

A rectifier 9 has a construction identical to that of the counterpart in the first embodiment, and includes a diode 9*a*. In the third embodiment, the diode D2 is connected to the duty factor controller 23, and the temperature-versus-forward voltage drop characteristics of the diode 9*a*is compensated for by the diode D2.

In the third embodiment, a second oscillator 25 is constructed of an oscillator separate from the first oscillator 2. The oscillation frequency of the second oscillator 25 is set independently of the oscillation frequency of the first oscillator 2.

A capacitor 25*b* is connected between the second oscillator 25 and ground potential. Furthermore, a resistor 25*c* is connected between the second oscillator circuit 25*a* and ground potential. A resistor 25*e* and a PTC thermistor element 25*f* are connected between a junction 25*d* of the resistor 25*c* and the second oscillator 25 and ground potential. Furthermore, a resistor 25*g* is connected between a junction of the resistor 25*e* and the PET thermistor element 25*f* and ground potential.

The capacitor 25*b*, the resistors 25*c*, 25*e*, and 25*g*, and the thermistor element 25*f* are configured to perform temperature compensation of the second oscillator 25. This temperature-compensating circuit has the same construction as that shown in FIG. 7D. Referring to FIG. 7D, the construction will be detailed later.

In the third embodiment, the second oscillator 25 is fabricated of the second oscillator circuit 25*a*, independent of the first oscillator 2. As in the first embodiment, the second oscillator may be constructed of a frequency divider that frequency-divides the output of the first oscillator 2.

The third embodiment uses a third oscillator 26*a*. The third oscillator 26*a* is connected to a normal input terminal of a comparator 26*b*. An inverting input terminal of the comparator 26*b* is connected to a second dimmer signal input terminal 26*c*. The third oscillator 26*a* generates a triangular wave having a frequency within a frequency range from 100 to 1000 Hz. The comparator 26*b* compares the triangular wave with the second dimmer signal voltage, thereby generating a rectangular pulse having a frequency within a range of 100 to 1000 Hz.

The rectangular pulse is fed to the gates of the FET24*c* and FET24*d* of the piezoelectric transformer driver 24. With the rectangular pulse forcing the gates of the FET24*c* and FET24*d* down to ground potential, the discharge tube 7 is lit or extinguished at a frequency of 100 to 1000 Hz.

By changing the voltage of the second dimmer signal, a light time ratio of the discharge tube 7 is changed, and burst light adjustment is thus performed.

The second dimmer signal is a direct-current voltage in this embodiment. A rectangular pulse signal having a frequency within a range of 100 to 1000 Hz, similar to the output of the comparator 26*b*, may be used as the externally applied second dimmer signal.

In the third embodiment, a duty factor hold unit 27 is connected to the rectifier 9. The duty factor hold unit 27 includes a PNP transistor 27*a* as a switching element. The emitter of the transistor 27*a* is connected to a reference voltage, and the collector thereof is connected one end of a diode 27*b*. The diode 27*b* is configured in such a manner that the backward direction thereof is aligned with a direction toward the transistor 27*a*. The other end of the diode 27*b* is connected to a resistor R11. The resistor R11 is connected to the output terminal of the rectifier 9.

One end of a resistor R27 is connected to the base of the transistor 27*a*. The other end of the resistor 27 is connected to the collector of an NPN transistor 27*c* as a switching element. The emitter of the transistor 27*c* is grounded, and the base thereof is connected to an output terminal of the comparator 26*b* through a resistor 27*d*.

The operation of the duty factor hold unit 27 is now discussed, focusing problems that would arise without duty factor hold unit 27.

During a burst off period, i.e., a duration of time during which the discharge tube 7 remains off, the load current becomes zero, and the output of the rectifier 9 also becomes zero. The output voltage of the comparator 3*a* rises, expanding the on-duty width of the pulse of the input voltage controller 1. When the burst off period alternates with a burst on period, the mean value of the output voltage of the input voltage controller 1 becomes high, causing an excessive current to flow through the discharge tube 7, and light adjustment cannot be performed.

In the third embodiment, a voltage, approximately equal to the voltage appearing at the output of the rectifier 9 during the burst on period, is introduced to the output of the rectifier 9 by the duty factor hold unit 27 through the resistor R11 during the burst off period. With this arrangement, the output voltage of the comparator 3*a*, i.e., a variation in the on-duty width of the input voltage controller 1 is thus controlled.

The piezoelectric inverter of the third embodiment performs burst light adjustment by inputting the second dimmer signal voltage. The third embodiment thus performs light adjustment within a wide range, compared with the first embodiment. The duty factor hold unit 27 controls variations in the duty factor during the burst off period. The duty factor hold unit 27 is merely arranged to introduce an appropriate voltage to the output of the rectifier 9, and the variation in the duty factor of the burst off period is controlled at low costs.

In the third embodiment, temperature compensation for the second oscillator 25 is performed with the capacitor 25*b* connected to the second oscillator 25. The temperature compensation and frequency-setting method are appropriately modified and changed.

FIG. 7A through FIG. 7D show modifications of the frequency setting method in the second oscillator.

Figure 7A:
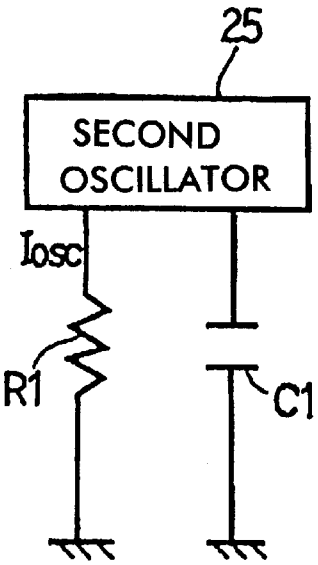
FIG. 7A through FIG. 7D are circuit diagrams of temperature-compensating circuits connected to a second frequency oscillator.
Figure 7B:
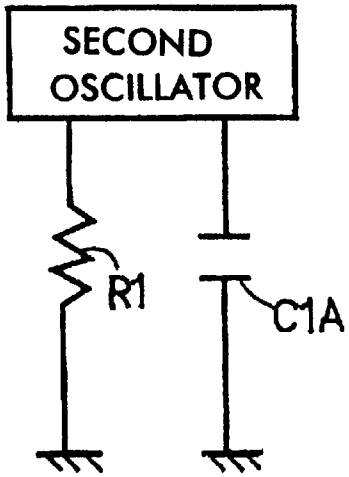

Referring to FIG. 7A, the second oscillator 25 is connected to a capacitor C1 and a resistor R1, external thereto. The capacitor C1 is charged and discharged with a current $I_{OSC}$ flowing out of the second oscillator 25 into the resistor R1. A signal having a certain frequency is thus generated.

As the resistance of the resistor R1 decreases, the current $I_{OSC}$ increases, the rate of charge and discharge of the capacitor C1 becomes fast, and the oscillation frequency is thus increased. As the capacitance of the capacitor C1 decreases, the oscillation frequency also increases because the voltage across the capacitor C1 rises fast even if the capacitor C1 is charged and discharged with the same current $I_{OSC}$.

If the ambient temperature varies, the voltage $V_{OSC}$ varies because of the temperature characteristics of parts in the second oscillator, and there is a fear that the oscillation frequency of the second oscillator may vary. The problem of the variation in the oscillation frequency is now discussed, referring to FIG. 13.

Figure 13:
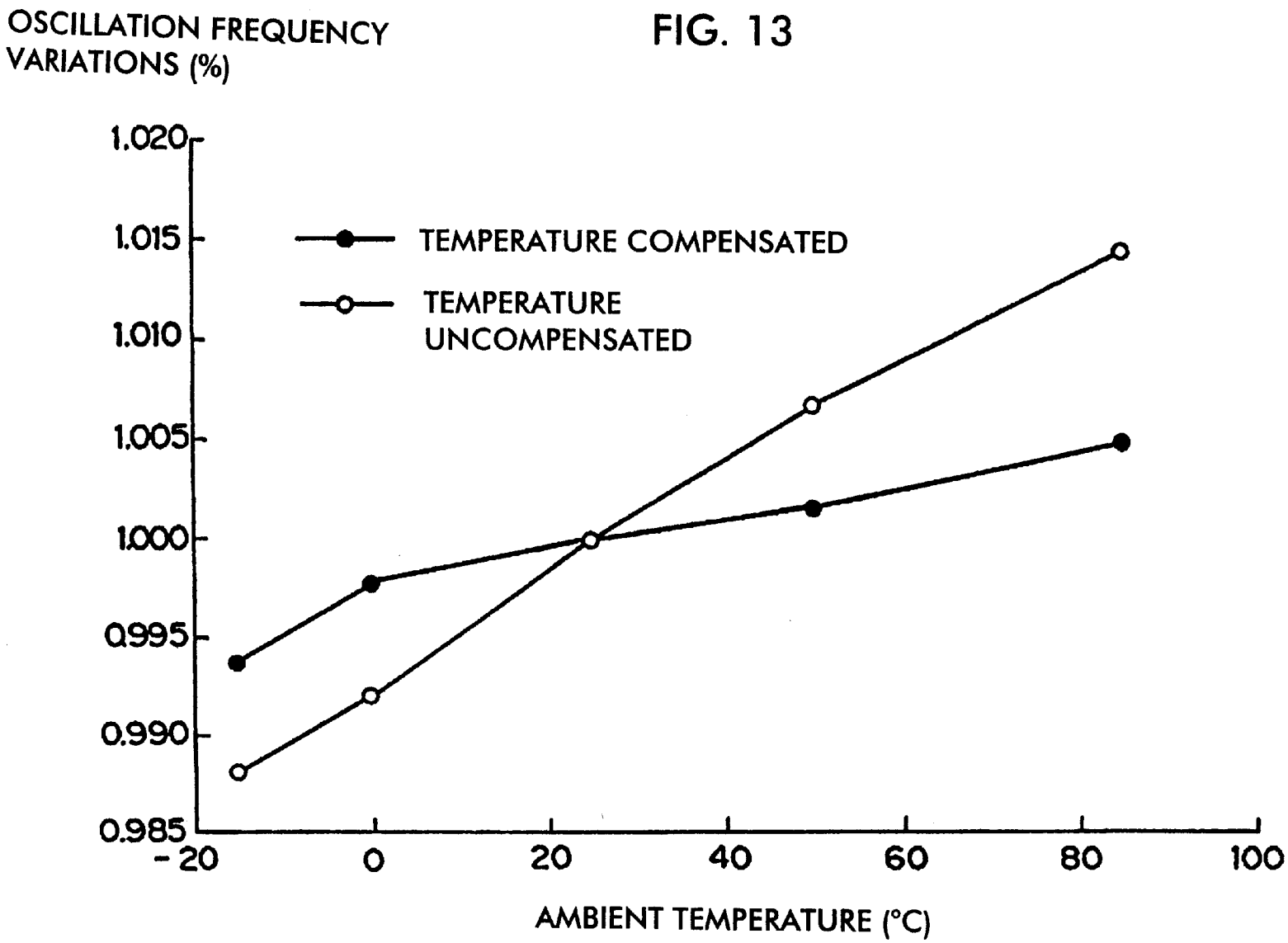
FIG. 13 is a graph showing oscillation frequency-versus-temperature characteristics of an oscillator.

FIG. 13 shows the relationship between the variation in the oscillation frequency and the ambient temperature in the second oscillator. Blank circles connected by lines represent temperature-uncompensated frequency variations. A fixed-frequency type oscillator increases in oscillation frequency as the ambient temperature rises. In other words, as the temperature rises, the multiplication gain of the piezoelectric transformer 6 drops. When such an oscillator is used for the second oscillator 25, the mean output voltage of the input voltage controller 1 results as shown in FIG. 14 when the discharge tube 7 is a cold-cathode tube and an LCD (liquid-crystal display) panel is lit with a constant liquid current.

Figure 14:
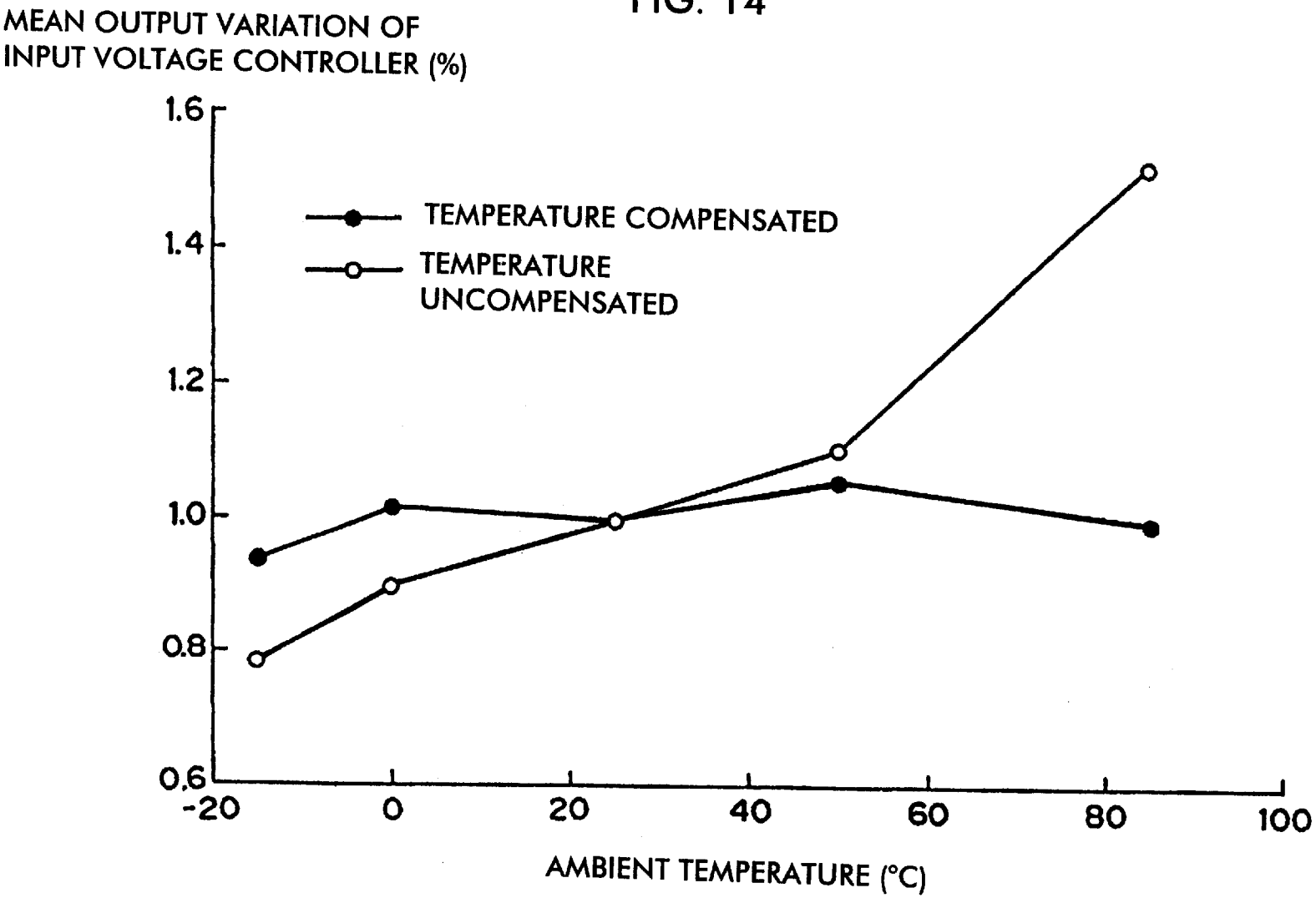
FIG. 14 is a graph showing output-versus-temperature characteristics of an input voltage controller.

As represented by the blank circles in FIG. 14, the output voltage of the input voltage controller 1 greatly varies as the ambient temperature rises. If temperature compensation is not performed, the mean output of the input voltage controller 1 increases to compensate for a drop in the multiplication gain of the piezoelectric transformer 6 as the ambient temperature rises.

In response to the variation in the ambient temperature, the variation in the input voltage controller 1 changes within a range of 0.8 to 1.5. This range of variation presents the difficulty of designing the piezoelectric inverter.

If oscillation frequency-versus-temperature characteristics of the second oscillator 25 are compensated for as represented by solid circles connected by lines as shown in FIG. 13 and FIG. 14, the dependence of the oscillation frequency on temperature is reduced, and the temperature dependence of the mean output voltage of the input voltage controller 1 is significantly flattened.

Referring to FIG. 13, the temperature-compensated oscillation frequency slightly rises with the temperature increase. Referring to FIG. 14, the mean output voltage of the input voltage controller 1 remains substantially constant regardless of the temperature increase when temperature compensation is performed. This is because the tube voltage in an LCD panel drops at a high temperature, and a smaller gain is acceptable as the temperature gets higher.

When the oscillation frequency of the second oscillator 25 exhibits positive-temperature-coefficient characteristics as shown in FIG. 13, a temperature-compensating capacitor $C_{1A}$ having positive-temperature-coefficient capacitance-versus-temperature characteristics is substituted for the capacitor $C_1$.

With the temperature-compensating capacitor $C_{1A}$, having positive-temperature-coefficient capacitance-versus-temperature characteristics, employed, the temperature dependence of the mean output voltage of the input voltage controller 1 is controlled.

Figure 7C:
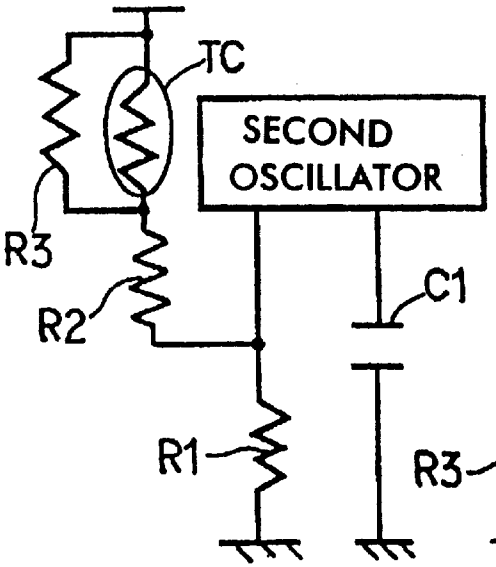
Figure 7D:
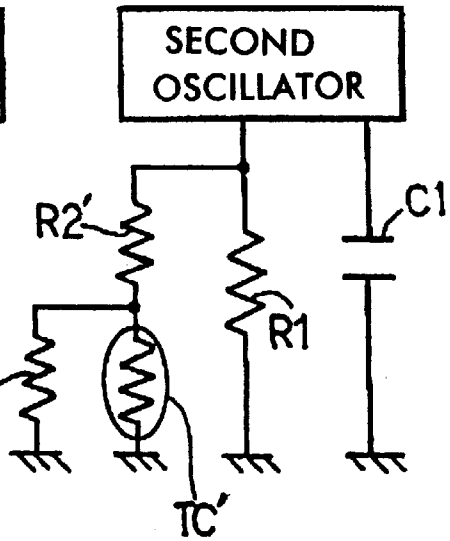

Referring to FIG. 7C, a negative-temperature-coefficient thermistor TC and a resistor R2 are connected between an external reference voltage and the junction of an oscillation-frequency-setting resistor R1 and the second oscillator 25. A resistor R3 is connected in parallel with the negative-temperature-coefficient thermistor TC. A current is permitted to flow from the external reference voltage into the resistor terminal of the second oscillator 25. The temperature compensation is performed so that the current value is controlled to be small as temperature rises.

Referring to FIG. 7D, when the second oscillator 25 has negative-temperature-coefficient frequency-versus-temperature characteristics, a resistor R2' and a negative-temperature-coefficient thermistor TC' are connected in parallel with are sistor R1 relative to common line. The current flowing out of the resistor terminal of the second oscillator 25 is increased with temperature increase.

When the resistances of the resistors R1, R2, and R3, the negative-temperature-coefficient thermistor TC, the resistors R1, R2', and R3, and the negative-temperature-coefficient thermistor TC' are appropriately set as shown in FIG. 7C and FIG. 7D, the oscillation frequency at normal temperatures is set to be equal to that obtained in the second oscillator shown in FIG. 7A.

The temperature-compensating circuits shown in FIG. 7C through FIG. 7D employ the negative-temperature-coefficient thermistors. Alternatively, a positive-temperature-coefficient thermistor may be employed by modifying the circuit arrangement.

As discussed above, temperature compensation is performed by using a variety of circuits taking into consideration various features such as temperature characteristics of the second oscillator 25. When the temperature characteristics of the second oscillator 25 are controlled to within a desired range, the temperature dependence of the mean output voltage of the input voltage controller 1 is thus controlled. When the temperature dependence of the output of the input voltage controller 1 is large, the output voltage needs to be set to be low at normal temperatures with some margin implemented in design. A piezoelectric transformer 6 having a large voltage multiplication ratio needs to be used, and is economically disadvantageous. With the temperature-compensating circuit incorporated in this embodiment, this problem is resolved. The cost of the piezoelectric inverter is thus reduced.

Figure 8:
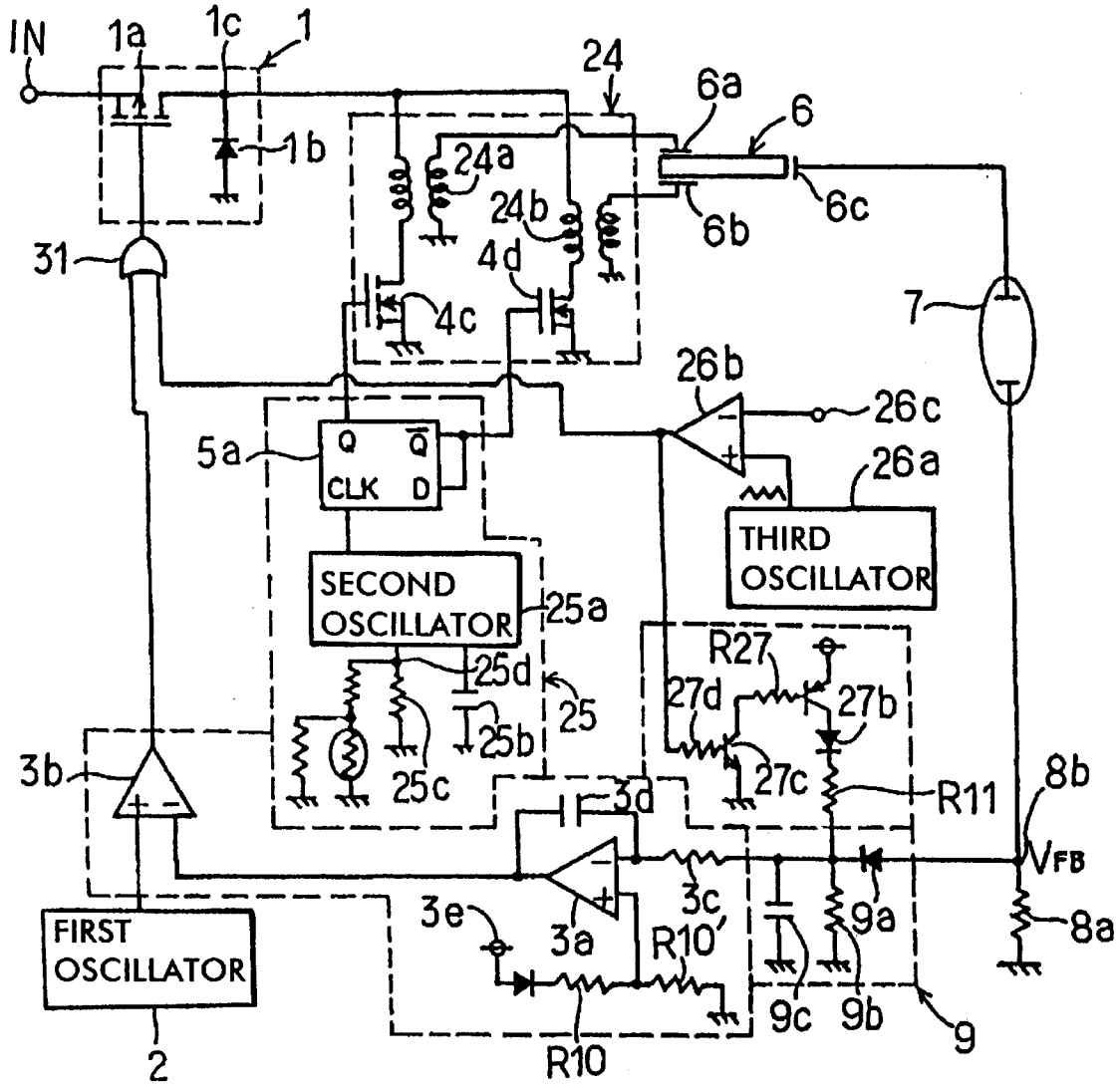
FIG. 8 is a circuit diagram showing a piezoelectric inverter of a fourth embodiment of the present invention.

FIG. 8 is a circuit diagram showing a piezoelectric inverter of a fourth embodiment of the present invention. In the piezoelectric inverter of the third embodiment, the FET24*a* and FET24*b* as switching elements in the piezoelectric transformer driver 24 are set to an off state to create the burst off period. The fourth embodiment employs an OR gate 31 to stop the driving of the input voltage controller 1.

In the fourth embodiment, the output terminal of a third comparator 26*b* is connected to one input terminal of the OR gate 31. The output terminal of a second comparator 3*b* is connected to the other input terminal of the OR gate 31. The output terminal of the OR gate 31 is connected to the gate electrode of FET1*a* in the input voltage controller 1.

The rest of the construction of the fourth embodiment remains unchanged from that of the third embodiment. Components identical to those described in connection with the third embodiment are designated with the same reference numerals and the discussion thereabout is not repeated here.

When either the output of the comparator 3*b* or the output of the comparator 26*b* is in a high state, the OR gate 31 outputs, to the FET1*a*, a signal for stopping the driving of the FET1*a*. During the burst off period, the stop signal from the OR gate 31 stops the operation of the FET1*a*. The circuit arrangement for creating the burst off period may be modified as appropriate, for instance, by incorporating the OR gate 31.

In the third embodiment, energy stored in inductance of the isolating transformers 24*a* and 23*b* becomes surge voltages at the transition into a burst off period. The surge voltages appear between the drain and source of each of the FET24*c* and FET24*d*.

To protect the FET24*c* and FET24*d* from the surge voltage, Zener diodes 24*f* and 24*g* need to be connected thereto. In the fourth embodiment, no such surge voltages take place. The circuit arrangement of the fourth embodiment is thus simplified, and the reliability thereof is improved.

Figure 9:
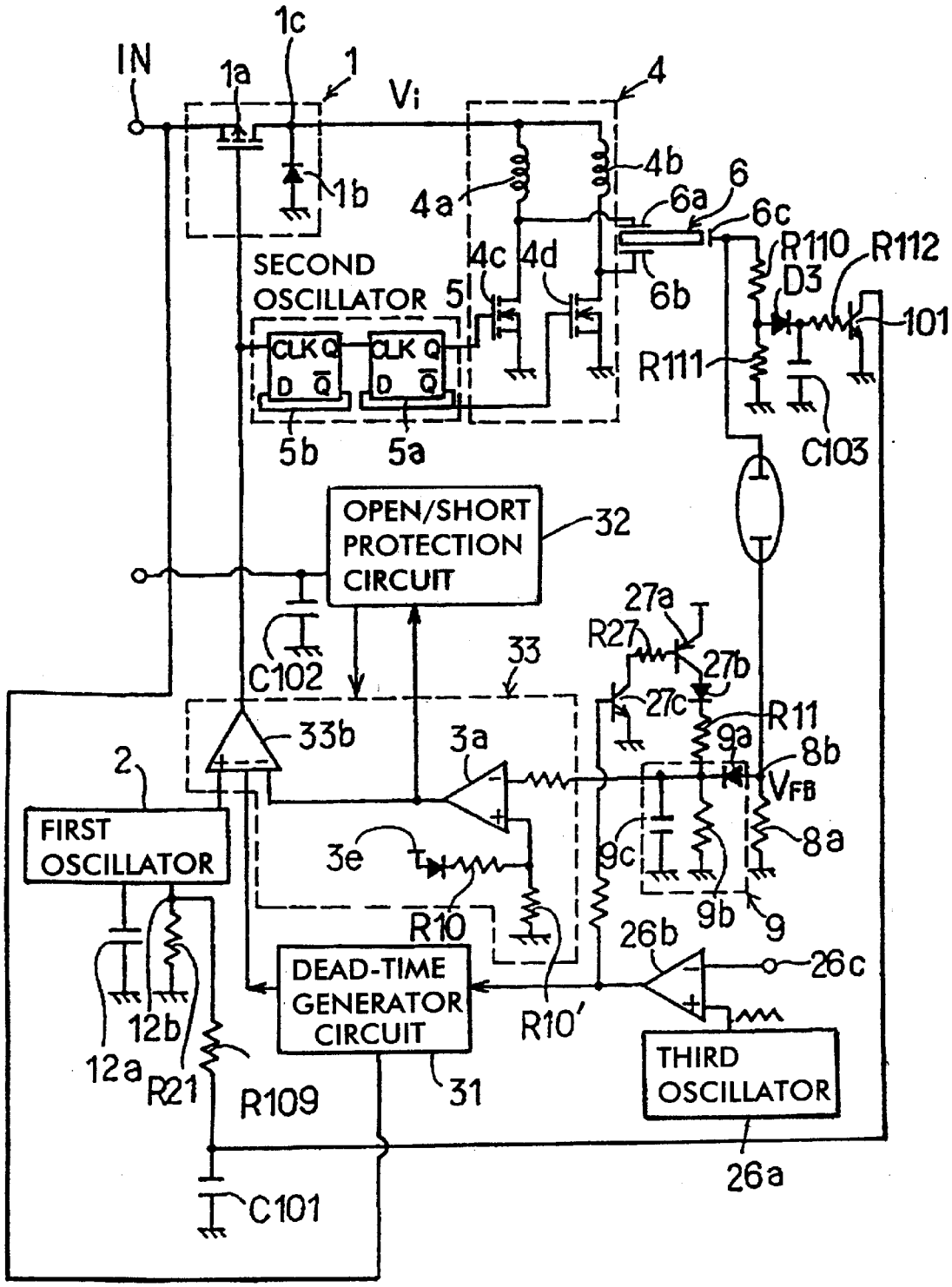
FIG. 9 is a circuit diagram showing a piezoelectric inverter of a fifth embodiment of the present invention.

FIG. 9 is a circuit diagram showing a piezoelectric inverter of a fifth embodiment of the present invention.

In the fifth embodiment, a third comparator 33*b* has three input terminals, namely, two inverting input terminals and one normal input terminal. A dead-time generator circuit 31 is connected to one of the two inverting input terminals.

The output terminal of a third comparator 26*b* is connected to not only the rectifier 9 but also the dead-time generator circuit31. The dead-time generator circuit 31is also connected to the input terminal IN.

The dead-time generator circuit 31 is arranged to perform a dead-time function. The dead-time function controls the duty factor of the rectangular pulse, which is the output of a second comparator 33*b*, to be not greater than a constant value, independently of an output voltage $V_{FB}$ of the tube current.

Specifically, in the fifth embodiment, the output signal of the dead-time generator circuit 31 is input to the second comparator 33*b*, thereby controlling the duty factor of the output pulse of the second comparator 33*b*.

Without the dead-time function, the following problem arises.

In economical design, the mean output voltage of the input voltage controller 1 is set to be 6.5 V or so in the piezoelectric inverter having the input voltage specification of 7 to 12 V. In such a case, the mean output voltage of the input voltage controller 1 is maintained to 6.5 V regardless of the input voltage value, when the load current is controlled to be constant, namely, during feedback control. According to the quasi-class-E multiplication effect of the piezoelectric transformer driver 4, the output voltage of the piezoelectric transformer driver 4 is approximately 20 V peak voltage (=5 V×3). TheFET24*c* and FET24*d* in the piezoelectric transformer driver 4 in use have withstand voltage of approximately 60 V.

The duration during which the feedback control is inoperative, for instance, in immediate succession to a startup, is considered. More specifically, now the piezoelectric inverter is started with a 21 V input. The load current is zero immediately subsequent to the startup. In the first embodiment, the comparators 3*a* and 3*b* perform control to result in a duty factor of 100% in the input voltage controller 1. The mean output voltage of the input voltage controller 1 becomes 21 V, and a peak voltage of 63 V (=21V×3) is fed to the FET in the piezoelectric transformer driver 4. FETs having withstand voltage rating of 60 V cannot be used. FETS having higher withstand voltage may be used. This is not preferable in view of dimensions, performance, and costs.

Figure 15:
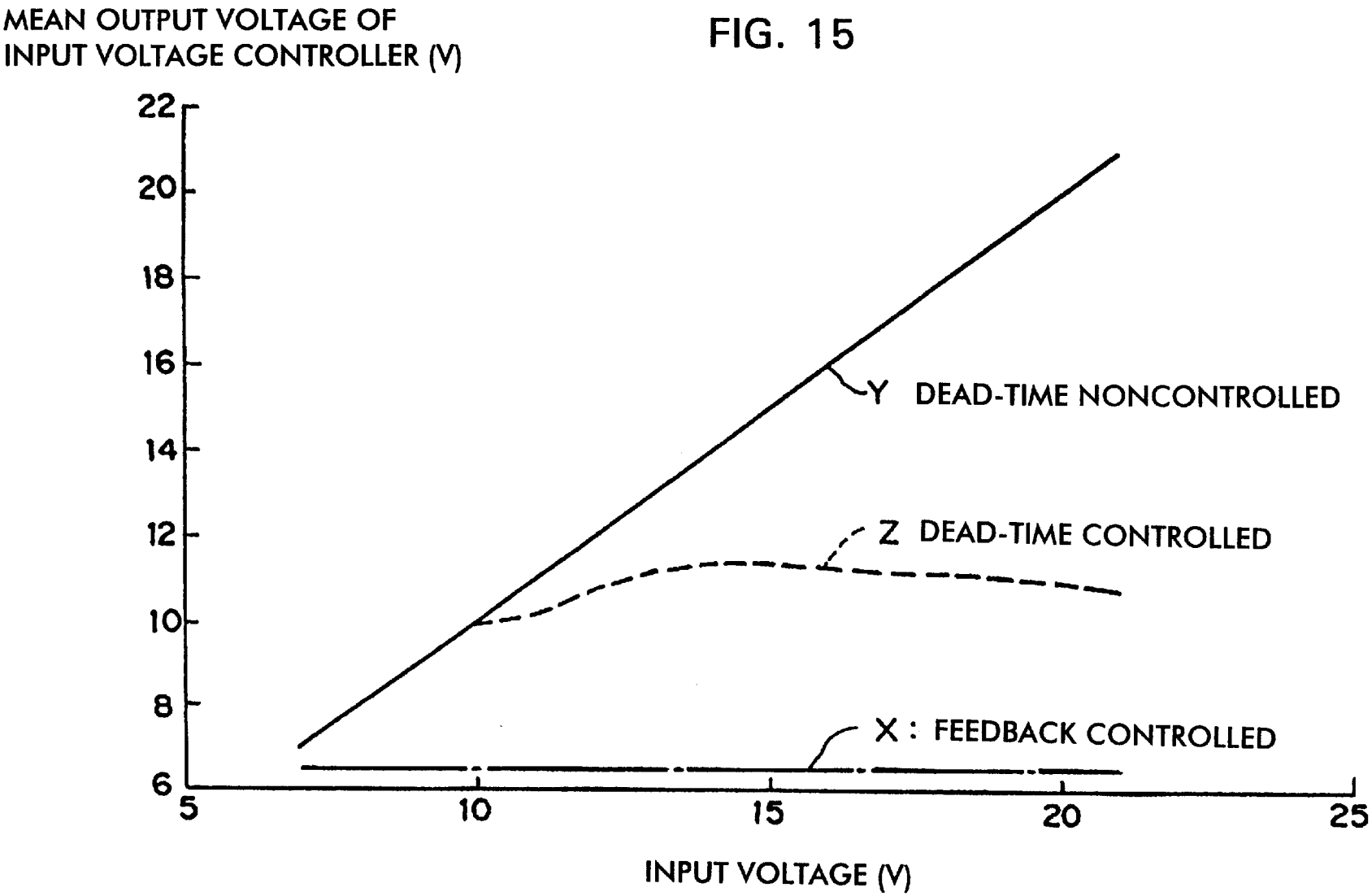
FIG. 15 is a graph showing the dependence of the output of the input voltage controller on an input voltage when dead-time control is used.

In contrast, the fifth embodiment is arranged so that the input voltage is applied to the dead-time generator circuit 31 via the input voltage terminal IN. The output voltage of the dead-time generator circuit 31 varies in response to the input voltage. FIG. 15 shows the mean output voltage of the input voltage controller 1.

Referring to FIG. 15, a one-dot chain line X represents the mean output voltage of the input voltage controller 1 during the feedback control, and shows that the mean output voltage of the input voltage controller 1 is substantially constant regardless of variations in the input voltage. As represented by a solid line Y in an out-of-feedback control state, the mean output voltage of the input voltage controller 1 becomes high as the input voltage rises when no dead-time generator circuit is employed.

In the fifth embodiment with the dead-time generator circuit 31 incorporated, the mean output voltage of the input voltage controller 1 remains substantially constant and is controlled to 12 V or lower with the dead-time generator circuit 31 incorporated even when the input voltage rises. The use of the dead-time generator circuit 31 permits the piezoelectric transformer driver 4 to be fabricated of FETs having a withstand voltage of 60 V.

The dead-time function is also used to result in the burst off period in the fifth embodiment. The output of the comparator 26*b* is fed to the dead-time generator circuit 31. The output of the comparator 33*b* is set to be a duty factor of zero percent with the output of the comparator 26*b* transitioned to a high state. With this arrangement, the output of the input voltage controller 1 becomes zero, achieving the burst off period.

During the burst off period, a transistor 27*a* is concurrently turned on. By equalizing a resistor R10 and a resistor R11 in resistance and by equalizing a resistor R10' and a resistor 9*b* in resistance, the problem of an excessive duty factor during the burst off period is prevented in the same manner as in the third and fourth embodiment. Specifically, the use of the dead-time function helps perform a burst light adjustment with a simple circuit arrangement.

The fifth embodiment also includes an open/short protection circuit 32. The open/short protection circuit 32 is connected to the output terminal of the first comparator 3*a*, thereby receiving a feedback voltage.

The open/short protection circuit 32 may be fabricated of a timer latch circuit such as a general-purpose PWMIC.

The operation of the open/short protection circuit 32 is now discussed. Now, the output voltage of the rectifier 9, namely, the feedback voltage ($V_{FB}$) is transitioned to a high state. When the value $V_{FB}$ rises in excess of a predetermined constant voltage, a capacitor 102 connected to a time-constant setting terminal of the open/short protection circuit 32 starts to be charged. When the voltage at the time-constant setting terminal rises above a constant voltage, the general operation of the piezoelectric inverter stops.

In abnormal states in which the output of the piezoelectric transformer is opened or shorted to ground, the load current becomes zero, and the output of the rectifier 9 also becomes zero. An open/short protection operation is thus carried out, stopping the operation of the piezoelectric inverter when an abnormal state continues for a predetermined duration of time.

The piezoelectric inverter requires a preventive step to cope with the inability to light under dark conditions (the cold-cathode tube is unable to light under fully dark lighting conditions). To this end, the function required of the piezoelectric inverter is to output a voltage not lower than a light enable voltage for a constant duration of time rather than stopping immediately in case of an output opening. The "constant duration of time" is varied depending on the operational conditions under which the user uses the inverter, and is specifically varied from one second to a longtime. The constant duration of time is preferably externally set.

In the fifth embodiment, the capacitor 102 has a minimum required capacitance, and an interconnect terminal for an external capacitor is connected to the time-constant-setting terminal. A capacitor is connected to the external capacitor terminal as necessary, and by changing the capacitance of the external capacitor, the constant duration of time is easily adjusted.

The protection operation during the abnormal event is performed only by substantially fixing the drive frequency of the piezoelectric transformer.

When the protection operation is performed in the method discussed above, the same time constant applies to an open and a short of the output of the piezoelectric transformer 6. As already discussed, in the event of an open circuit, a delay time of one second or longer from the occurrence of the open circuit to the protection operation is typically required. In the event of a short circuit as well, the protection operation is initiated after an elapse of one second.

When the output of the piezoelectric transformer 6 is shorted, the oscillation frequency (the frequency at which the input impedance of the piezoelectric transformer 6 is minimized) is present among frequencies lower than normal. In the piezoelectric transformer having the frequency-versus-gain characteristics shown in FIG. 4, the input impedance is minimized within a frequency range from 54 to 55 kHz. With the piezoelectric transformer 6 driven by the frequency within this range, large energy is fed thereto, and the piezoelectric transformer 6 is subject to failures such as a open circuit.

The conventional art, disclosed in Japanese Unexamined Publication No. 7-220888, constantly drives the piezoelectric transformer with a resonance frequency, and an open circuit of the transformer is inevitable. In the conventional art shown in Japanese Unexamined Patent Publication No.

9-107684, the load current is unable to reach a target value when the output of the piezoelectric transformer is shorted. Frequency sweep means decreases the drive frequency of the piezoelectric transformer. The drive frequency passes the resonance frequency that minimizes the input impedance and sweeps into a lower frequency. Since the delay time prior to the circuit protection against an abnormal event is one second or longer, the piezoelectric transformer is also subject to an opening.

Since the frequency of the piezoelectric transformer is fixed in the piezoelectric inverter of the present invention, the piezoelectric inverter does not operate at the resonance frequency in the event of abnormal events. Energy input to the piezoelectric transformer 6 is thus restricted. If a short state continues for one second or longer, the piezoelectric transformer 6 is free from an open circuit.

The protection during output opening is now discussed.

During the output opening, a voltage is continuously fed for a constant duration of time until the open/short protection circuit 32 is initialized. The operational frequency of the piezoelectric transformer 6 (the oscillation frequency of the second oscillator) is fixed, and the piezoelectric transformer operates in a region having a high gain at an opening as shown in FIG. 12. The output of the first oscillator 12 becomes excessively large, and there is a fear that unnecessary discharges and breakdown of the transformer may take place.

In the fifth embodiment, resistors R110 and R111 voltage-divide the output of the piezoelectric transformer 6, and a divided voltage drives a transistor Q101. The output voltage is thus controlled at the opening.

When the output of the piezoelectric transformer 6 rises above a constant voltage that is determined by a division ratio of the resistors R110 and R111, the transistor Q101 is turned on. One end of a resistor R109 is grounded. As a result, a current flowing out of a resistor connecting terminal of the first oscillator 2 increases, increasing the oscillation frequency of the first oscillator 2. The transformer drive frequency, which is obtained by dividing the increased oscillation frequency by four, is also increased.

Referring to FIG. 12, as the drive frequency increases, the gain of the piezoelectric transformer decreases, and the output voltage drops. In other words, in the event of an open output of the transformer, the output voltage is maintained to the constant voltage determined by the division ratio of the resistors R110 and R111. Unnecessary discharges and opening of the piezoelectric transformer are thus prevented.

Connected between the junction of voltage division and the base of the transistor Q101 are a diode D3 and a resistor R112 in series connection. A capacitor C103 is connected between the junction of the resistor 112 and the diode D3 and ground potential. The collector of the transistor 101 is connected to the junction of the resistor R109 and the capacitor 101. The resistor R109 and the capacitor C101 are connected between the junction 12*b* and ground potential.

Under normal operating conditions, a constant voltage $V_{OSC}$ determined in the design of the first oscillator 2 is fed across the capacitor 101. Prior to startup, the voltage applied to the capacitor 101 is zero. A current for charging the capacitor 101 flows through the resistor R109 for a constant duration of time at the startup. At the startup, lighting is performed with frequency sweeping from a frequency higher than frequencies in normal operating conditions to a low frequency side. With this function implemented, an excessive current is prevented from flowing through the load at the startup.

Figure 10:
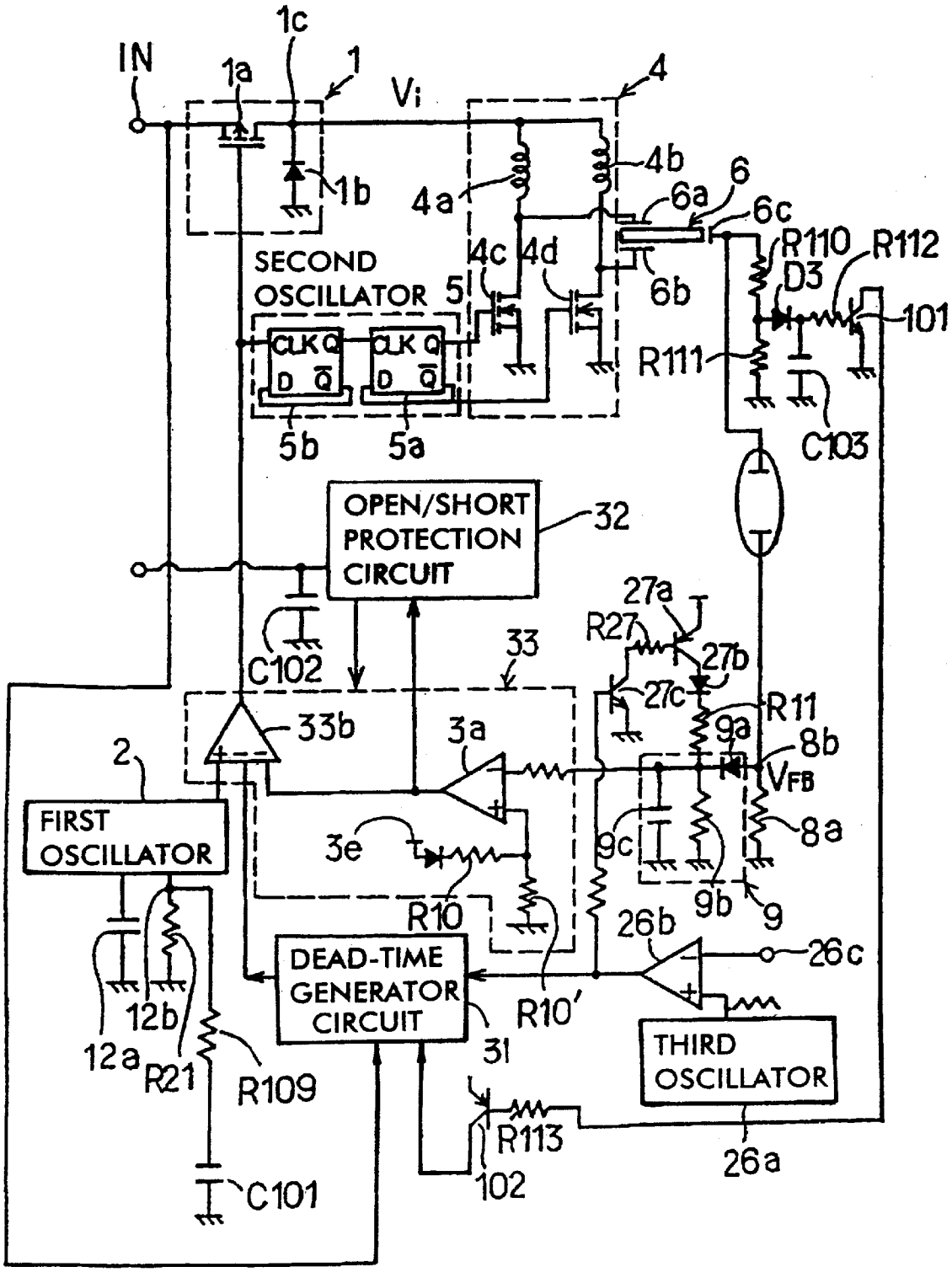
FIG. 10 is a circuit diagram showing a piezoelectric inverter of a sixth embodiment of the present invention.

FIG. 10 is a circuit diagram showing a piezoelectric inverter of a sixth embodiment of the present invention.

The sixth embodiment remains unchanged from the fifth embodiment shown in FIG. 9, except for the protection operation in the event of an output open circuit. The rest of the construction is not discussed here.

Referring to FIG. 10, the collector of the transistor Q101 is connected to one end of a resistor R113, and the other end of the resistor R113 is connected to the base of a transistor Q102. The emitter of the transistor Q102 is connected to a reference voltage, the collector thereof is connected to the dead-time generator circuit 31. The input terminal of the dead-time generator circuit 31 is designed to be at a duty factor of zero percent when the collector voltage of the transistor Q102 is in a high state, namely, to the reference voltage.

When the output of the piezoelectric inverter is opened, i.e., without load, for some reason, the output voltage of the piezoelectric transformer increases in the same way as shown in FIG. 9. The anode voltage of the diode D3 increases, causing the diode D3 to be conductive, and thereby turning on the transistor Q101. The transistor Q102 is turned on through the resistor R113, feeding a high signal to the dead-time generator circuit 31. The duty factor of the input voltage controller 1 becomes zero percent, reducing the input voltage to the piezoelectric transformer 6, and thereby reducing the output voltage of the piezoelectric transformer 6. An initial excessive rise in the piezoelectric transformer output voltage is thus prevented. With the piezoelectric transformer output voltage decreased, the transistors Q101 and Q102 are turned off. The duty factor in the input voltage controller 1 starts expanding again. The input voltage controller repeats on and off operations on the mean output voltage thereof, while preventing an excessive voltage from being output.

In the above discussion, the transistor Q102 is fully turned on, and the duty factor of the switching element of the input voltage controller 1 becomes zero percent. Reducing the duty factor down to zero percent is not a requirement. Specifically, the transistors Q101 and Q102 are used in a linear region (a half-on region) so that the input voltage to the dead-time generator circuit 31 is controlled to be an intermediate voltage, higher than zero V and lower than the reference voltage. The output of the input voltage controller 1 does not fully become zero, but agrees with a substantially constant voltage so that the piezoelectric inverter output voltage continuously coincides with a target open voltage.

In both cases, the voltage higher than the light enable voltage is continuously output, while the protection operation is performed to control the generation of excessive voltages.

Figure 11:
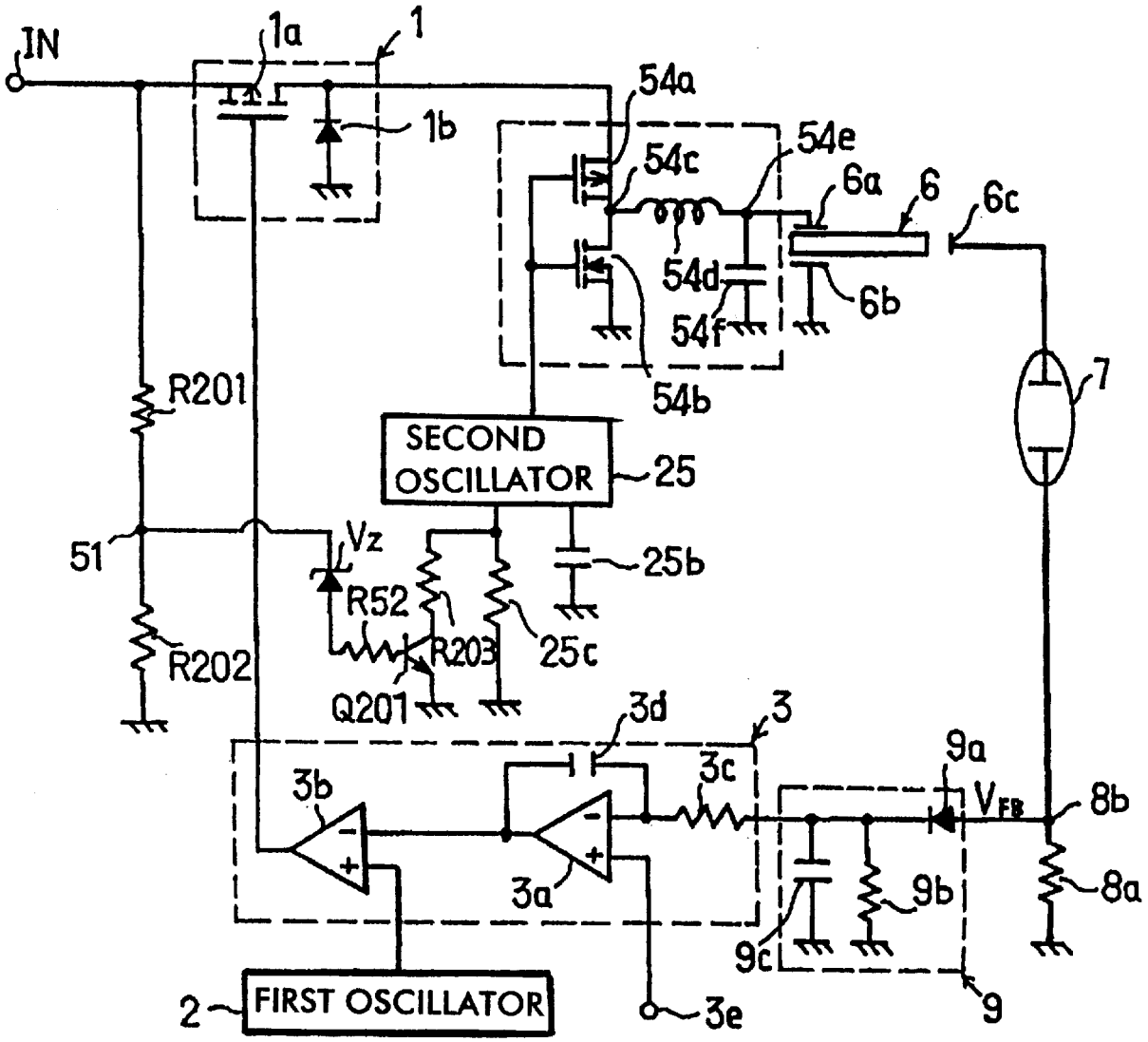
FIG. 11 is a circuit diagram showing a piezoelectric inverter of a seventh embodiment of the present invention.

FIG. 11 is a circuit diagram showing a piezoelectric inverter of a seventh embodiment of the present invention.

In the seventh embodiment, a piezoelectric transformer driver 54 includes two FET54*a* and FET54*b* configured in a half bridge. The output of the input voltage controller 1 is fed to the source of the P-type FET54*a*. The drain of the FET54*a* is connected to the drain of the FET54*b*. The source of the FET54*b* is grounded. The gates of the FET54*a* and FET54*b* are commonly connected to the second oscillator 25.

One end of an inductor 54*d* is connected to a junction 54*c* to which the drains of the FET54*a* and FET53*b* are commonly connected. The other end of the inductor 54*d* is connected to a first input electrode 6*a* of the piezoelectric transformer 6. A capacitor 54*f* is connected between a junction 54*e* of the other end of the inductor 54*d* and the input electrode 6*a* of the piezo electric transformer6 and ground potential. Specifically, an LC low-pass filter composed of the inductor 54*d* and the capacitor 54*f* is connected to the output of a drive circuit having a half-bridge configuration of the FET54*a* and FET54*b*. The output voltage, from which high-frequency components have been removed by the LC low-pass filter, is added to the piezoelectric transformer 6.

The resonance frequency of the LC filter, determined by the sum of the capacitance of the capacitor 54*f* and the input capacitance of the piezoelectric transformer 6 and the inductance of the inductor 54*d*, is substantially equalized to the drive frequency of the piezoelectric transformer 6. An optimum design is thus accomplished. The circuit arrangement of the piezoelectric transformer driver is not limited to any particular one. The circuit arrangement of the piezoelectric transformer driver of each preceding embodiment may be implemented. By connecting the LC low-pass filter, a voltage, from which unwanted high-frequency components are removed, is applied to the piezoelectric transformer.

In the seventh embodiment, the input voltage is divided by resistors 201 and 202. One end of a Zener diode vz is connected to a division junction 51 of the resistors 201 and 202, and the other end thereof is connected to the base of a transistor Q201 via a resistor R52. The collector of the transistor Q201 is connected to a frequency-setting-resistor terminal of the second oscillator 25 via a resistor R203. The emitter of the transistor Q201 is grounded.

The input voltage is divided by the resistors R201 and R202. When the divided voltage is higher than a Zener voltage of the Zener diode Vz, the Zener diode Vz becomes conductive. As a result, the transistor Q201 is turned on, increasing the frequency of the second oscillator 25. Conversely, when the input voltage drops, turning off the transistor Q201, a resistor R203 is isolated from ground potential. The oscillation frequency of the second oscillator thus drops. During the normal operational conditions, the piezoelectric inverter operates in a high-efficiency frequency region and maintains lighting even in the event of a voltage drop in the input voltage. This operation is now discussed.

Now discussed is the piezoelectric inverter for use in a notebook personal computer with an input voltage rating of 7 to 20 V and an input voltage of 10.8 V during a battery operation.

As clearly seen from FIG. 4, the frequency giving a maximum efficiency of the piezoelectric transformer 6 is slightly higher than a frequency giving a maximum gain. With an input voltage of 10.8 V, a frequency of 57.5 kHz providing a maximum efficiency is now used. The voltage multiplication gain of the piezoelectric transformer 6 is 34 dB, and there is a margin of 5 dB to the maximum gain of 39 dB.

Now considered is a rare case in which the input voltage drops down to 7 V. When the frequency is fixed to 57.5 kHz, the gain of the piezoelectric transformer 6 is also fixed. The on duty of the input voltage controller 1 needs to be increased to maintain the mean output voltage of the input voltage controller 1 to a certain value. Assuming that the required output voltage of the input voltage controller 1 is 8 V, the rectangular pulse duty becomes 100%, and a SCP function is activated, stopping the inverter.

By selecting appropriate resistances of the resistor R201, R202, and R203, the transistor Q201 is turned off with the input voltage smaller than 9 V, and the oscillation frequency set to move to 56.5 kHz, the gain of the piezoelectric transformer 6 increases to 38 dB with the input voltage of 9 V or smaller. The mean voltage of the input voltage controller 1 required for maintaining the load current drops, causing the inverter not to stop operating even from an input voltage of 7 V.

At an oscillation frequency of 56.6 kHz, the piezoelectric transformer presents an efficiency slightly lower than that at an oscillation frequency of 57.5 kHz. An input voltage smaller than 9 V is rarely input in actual operating conditions. An efficiency slightly lower in this frequency is not a problem in practice.

When the input voltage becomes lower than a desired constant value, a circuit for changing the oscillation frequency of the second oscillator to another frequency slightly lower than normal frequency is added. Lighting is assured within a wide range of input voltage and at the input voltage most frequently used, the piezoelectric transformer is thus driven at a frequency that provides a maximum efficiency of the piezoelectric transformer.

In the piezoelectric inverter of the present invention, the load is connected to the output electrode of the piezoelectric inverter, and the voltage control means controls the current flowing through the load to approximately the target current value. Since the voltage control means functions to control the mean voltage of the alternating-current voltage to the piezoelectric transformer, the load current is stabilized through single feedback control. The construction of the control circuit system is thus simplified and low cost. The input voltage controller, including the switching transistor and the current circulating element, is used for the voltage control means. When the duty factor of the input voltage controller is controlled so that the current flowing through the load approximately coincides with the target current value, a stepdown chopper circuit including the switching transistor and the current circulating element is constructed. Since the chopper circuit needs neither inductor nor capacitor for rectifying and smoothing, the component count is reduced. It is sufficient to control the duty factor of the input voltage controller, and the control system is thus simplified. A simplified and low-cost circuit arrangement thus results.

Since the input voltage controller, including the switching transistor and the current circulating element, needs neither smoothing means and rectifying means, the input voltage controller is free from loss involved in such smoothing and rectifying means.

The load current flowing through the load is detected by the load current detector, and the duty factor of the rectangular pulse of the input voltage controller is controlled by the duty factor controller so that the load current approximately coincides with the target current value. With a single feedback control loop, the load current is stabilized. In other words, the control system is simplified. A low-cost and reliable piezoelectric inverter results.

The operation frequencies of the input voltage controller and the piezoelectric transformer driver are respectively determined by the first oscillator and the second oscillator.

The piezoelectric inverter may include the frequency divider to divide the frequency of the first oscillator, and when the divided one of the frequency of the first oscillator is the output of the first oscillator, the first oscillator and the second oscillator are constructed of a single oscillator circuit. This arrangement simplifies the circuitry.

The oscillation frequency of the second oscillator is not higher than the frequency that gives a maximum voltage multiplication ratio of the piezoelectric transformer with the piezoelectric transformer having no load as the output thereof, and the oscillation frequency is not lower than the frequency that gives a maximum voltage multiplication ratio of the piezoelectric transformer with the piezoelectric transformer having the load. This arrangement provides a high efficiency, and controls the unstable operation in which the load current pulsates.

The piezoelectric inverter may also include the temperature-compensating circuit to correct the dependence of the oscillation frequency of the second oscillator on the ambient temperature. The required mean output voltage of the input voltage controller is thus controlled by the temperature compensation function. This arrangement reduces variations in the output of the input voltage controller, eliminates the need for a piezoelectric transformer having an unnecessarily higher voltage multiplication ratio, and results in a low-cost piezoelectric transformer.

Composed of the thermistor or the temperature-compensating capacitor, the temperature-compensating circuit is low cost.

When the target current value is varied in response to the first external dimmer signal, the load current is also varied in response to the first external dimmer signal. The adjustment of the load, such as the adjustment of the luminance of the discharge tube, is easily performed.

The piezoelectric transformer may also includes the variable oscillation-frequency circuit for varying the oscillation frequency of the second oscillator in response to the first dimmer signal without using feedback control. The variation in the mean output of the input voltage controller is set to be smaller than the variation in the set load current by varying the frequency of the second oscillator in response to the first dimmer signal. This arrangement increases the stability of the feedback control system, and further increases the reliability of the piezoelectric transformer.

The load drive time controller may also included to intermittently turn on and off the driving of the load to vary the on time ratio in response to the second external dimmer signal.

The load is intermittently turned on and off in response to the second dimmer signal. The burst light adjustment is thus achieved, increasing the range of light adjustment.

The piezoelectric inverter may also include the rectifier to rectify the load current from the load current detector and to output the direct-current voltage responsive to the load current. When the inverter works to set the load to be in an on state, or the load is in an on state, the voltage, substantially equal to the voltage occurring at the output of the rectifier, is applied to the output of the rectifier during a period throughout which the circuitry operates to set the load to be in an off state, or the load is in an off state. The variation in the duty factor of the output rectangular pulse of the duty factor controller is controlled during the burst off period. The light adjustment feature is thus improved.

The piezoelectric inverter may further include a dead-time controller for controlling the duty factor of the rectangular pulse of the input voltage controller to be not higher than a predetermined value, without dependence on a current flowing through the load and the output voltage of the rectifier. Since the duty factor of the rectangular pulse controlled by the dead-time controller varies in response to an input voltage, an excessive rise in the output of the input voltage controller is controlled with a high input voltage and in an out-of-feedback state. Low withstand voltage, thus low-cost FETs are used for the piezoelectric transformer. The burst light adjustment is cost-effectively performed.

The piezoelectric inverter may further include the circuit operation stopping unit which stops the operation of the circuit when a duration, during which the current flowing through the load fails to agree with the target current value, exceeds a predetermined constant duration of time. Unnecessary discharges and breakdown of the piezoelectric transformer are controlled, and the piezoelectric inverter is reliably protected.

The constant duration of time from the occurrence of an abnormal event to a stop of the operation of the circuit may be varied by a constant of a component externally connected. By selecting a proper external component, the constant duration of time is easily adjusted.

The rise in the output voltage of the piezoelectric transformer may be prevented by varying, toward a high frequency side, the oscillation frequency of the second oscillator when the output voltage of the piezoelectric transformer exceeds a desired value. In this case, a breakdown of the piezoelectric transformer is reliably prevented, and the piezoelectric inverter is protected.

The same effect results if the duty factor of the input voltage controller is controlled when the output voltage of the input voltage controller exceeds a desired value.

The startup operation is carried out while the oscillation frequency of the second oscillator sweeps from a high frequency side to a low frequency side. In this arrangement, an excessive output current is prevented from flowing at the startup.

The oscillation frequency of the second oscillator is shifted to a low frequency lower than the normal oscillation frequency when the input voltage is lower than a desired frequency. In this arrangement, the operational frequency of the piezoelectric transformer is shifted into a lower frequency side, thereby increasing the voltage multiplication gain. This reduces the possibility of aborted lighting of the discharge tube, and causes the discharge tube to reliably light. At the input voltage most frequently used, the piezoelectric transformer is thus driven at a frequency that provides a maximum efficiency of the piezoelectric transformer. The efficiency of the piezoelectric inverter is increased.

What is claimed is:

1. A piezoelectric inverter for driving a load using a piezoelectric transformer, comprising:

input voltage control means, having a switching transistor and a current circulating element, for converting a direct-current input voltage into a rectangular alternating-current voltage;

piezoelectric transformer drive means, connected between the input voltage control means and the piezoelectric transformer, and comprising an inductive element, for outputting, to the piezoelectric transformer, an alternating-current voltage having a substantially constant frequency that is lower than the frequency of an output alternlating-current voltage of the input voltage control means;

a first oscillator for determining an operating frequency of the input voltage control means;

a second oscillator for determining an operating frequency of the piezoelectric transformer drive means;

the piezoelectric transformer having an input electrode and an output electrode with the input electrode thereof connected to the piezoelectric transformer drive means and the output electrode thereof connected to the load;

load current detector means, connected to the load, for detecting a load current; and duty factor control means, connected to the load current detector means, for controlling a duty factor of a rectangular pulse of the input voltage control means in response to the output of the load current detector means so that the load current is maintained to a substantially constant target current value, wherein an oscillation frequency of the second oscillator is not higher than a frequency at which the voltage multiplication ratio of the piezoelectric transformer becomes maximized with no load applied to the output of the piezoelectric transformer, and the oscillation frequency of the second oscillator is not lower than a frequency at which the voltage multiplication ratio of the piezoelectric transformer becomes maximized with the piezoelectric transformer driving the load connected to the output thereof.

2. A piezoelectric inverter according to claim 1, wherein the second oscillator comprises a frequency divider that frequency-divides the frequency of the first oscillator, and a signal into which the frequency of the first oscillator is divided is the output of the second oscillator, and a single oscillator is shared by the first oscillator and the second oscillator.

3. A piezoelectric inverter according to claim 1, further comprising a temperature-compensating circuit which controls the temperature dependence of required mean output voltage of the input voltage control means, thereby compensating for the dependence of the oscillation frequency of the second oscillator on ambient temperature.

4. A piezoelectric inverter according to claim 3, wherein the temperature-compensating circuit comprises one of a thermistor or a temperature-compensating capacitor.

5. A piezoelectric inverter according to claim 1, wherein the target current value is changed in response to an externally applied, first dimmer signal.

6. A piezoelectric inverter according to claim 5, further comprising a variable oscillation-frequency circuit that varies the oscillation frequency of one of the first and second oscillators in response to the first dimmer signal without using feedback control.

7. A piezoelectric inverter according to claim 1, further comprising load drive time control means which varies an on time ratio of the load in response to an externally applied, second dimmer signal by switching on and off the driving of the load.

8. A piezoelectric inverter according to claim 7, further comprising rectifier means for rectifying the load current detected by the load current detector means and outputting a direct current responsive to the load current, wherein, when the inverter works to set the load to be in an on state, or the load is in on state, a voltage, substantially equal to a voltage occurring at the output of the rectifier means, is applied to the output of the rectifier means during a period throughout which the inverter operates to set the load to be in an off state, or the load is in an off state.

9. A piezoelectric inverter according to claim 1, further comprising dead-time control means for controlling a duty factor of a rectangular pulse of the input voltage control means to be not higher than a constant value, without dependence on a current flowing through the load and the output voltage of the rectifier means, wherein the duty factor of the rectangular pulse controlled by the dead-time control means varies in response to an input voltage.

10. A piezoelectric inverter according to claim 1, further comprising circuit operation stopping means which stops the operation of the circuit when a duration, during which the current flowing through the load fails to coincide with the target current value, exceeds a predetermined constant duration of time.

11. A piezoelectric inverter according to claim 10, wherein a constant duration of time from the occurrence of an abnormal event to a stop of the operation of the inverter is varied by a constant of an externally connected component.

12. A piezoelectric inverter according to claim 1, wherein an excessive rise in the output voltage of the piezoelectric transformer is prevented by varying, toward a high frequency side, the oscillation frequency of the second oscillator when the output voltage of the piezoelectric transformer exceeds a desired value.

13. A piezoelectric inverter according to claim 1, wherein an excessive rise in the output voltage of the piezoelectric transformer is prevented by decreasing the duty factor of the output rectangular pulse of the input voltage control means when the output voltage of the piezoelectric transformer exceeds a desired value.

14. A piezoelectric inverter according to claim 1, wherein a startup operation is carried out while the oscillation frequency of the second oscillator sweeps from a high frequency side to a low frequency side.

15. A piezoelectric inverter according to claim 1, wherein the oscillation frequency of the second oscillator is shifted to a low frequency lower than a normal oscillation frequency thereof when the input voltage is lower than a desired frequency.

16. A piezoelectric inverter according to claim 1, wherein the load is a discharge tube.

* * * * *